US012318881B2

(12) United States Patent
Fujimoto et al.

(10) Patent No.: US 12,318,881 B2
(45) Date of Patent: Jun. 3, 2025

(54) SUBSTRATE POLISHING APPARATUS AND SUBSTRATE POLISHING METHOD

(71) Applicant: EBARA CORPORATION, Tokyo (JP)

(72) Inventors: Takuya Fujimoto, Tokyo (JP); Nobuyuki Takada, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 502 days.

(21) Appl. No.: 17/700,816

(22) Filed: Mar. 22, 2022

(65) Prior Publication Data

US 2022/0305610 A1 Sep. 29, 2022

(30) Foreign Application Priority Data

Mar. 29, 2021 (JP) ..... 2021-054875
Dec. 10, 2021 (JP) ..... 2021-200604

(51) Int. Cl.
*B24B 37/013* (2012.01)
*B24B 37/04* (2012.01)

(52) U.S. Cl.
CPC ..... *B24B 37/013* (2013.01); *B24B 37/042* (2013.01)

(58) Field of Classification Search
CPC ..... B24B 37/005; B24B 37/013; B24B 37/04; B24B 37/042; B24B 37/10; B24B 37/105; B24B 49/12; B24B 55/02; B24B 7/228; H01L 22/12; H01L 22/30
USPC ..... 451/41
See application file for complete search history.

(56) References Cited

U.S. PATENT DOCUMENTS

2015/0017880 A1* 1/2015 Nomura ..... H01L 22/26 451/6

FOREIGN PATENT DOCUMENTS

| | | | | |
|---|---|---|---|---|
| CN | 110757278 A | * | 2/2020 | ..... B24B 27/0023 |
| JP | H09-298176 A | | 11/1997 | |
| JP | 2009111238 A | * | 5/2009 | |
| JP | 2016-078156 A | | 5/2016 | |

* cited by examiner

*Primary Examiner* — Eric J Rosen
*Assistant Examiner* — Aaron R McConnell
(74) *Attorney, Agent, or Firm* — BakerHostetler

(57) ABSTRACT

The substrate polishing apparatus capable of measuring a film thickness of a substrate with high accuracy without decreasing a transmittance of light when measuring the film thickness of a substrate being polished is disclosed. The substrate polishing apparatus includes: a stage; a polishing head configured to hold a polishing pad; a polishing-liquid supply nozzle; a film-thickness measuring head; a spectrum analyzer; and a head nozzle to which the film-thickness measuring head is attached. The head nozzle includes a first flow-passage system and a second flow-passage system each configured to form a flow of liquid across an optical path of light and reflected light, the first flow-passage system has an aperture located on the optical path, the second flow-passage system has a liquid outlet port and a liquid suction port located at both sides of the aperture.

14 Claims, 16 Drawing Sheets

SUBSTRATE POLISHING APPARATUS AND SUBSTRATE POLISHING METHOD

CROSS REFERENCE TO RELATED APPLICATION

This document claims priorities to Japanese Patent Application No. 2021-054875 filed Mar. 29, 2021 and Japanese Patent Application Number 2021-200604 filed Dec. 10, 2021 the entire contents of which are hereby incorporated by reference.

BACKGROUND

Chemical Mechanical Polishing (CMP) is a technique of polishing a substrate as an object to be polished by rubbing the substrate against a polishing surface of a polishing pad while supplying a polishing liquid containing abrasive grains, such as silica ($SiO_2$), onto the polishing surface of the polishing pad. Substrate polishing apparatuses used in the CMP process include a type in which a polishing-target surface of a substrate faces upward (face-up type) and a type in which a polishing-target surface of a substrate faces downward (face-down type).

The substrate polishing apparatus of the face-up type is configured to polish a substrate by placing the substrate on a stage with a polishing-target surface of a substrate facing upward, and contacting a polishing pad, which has a smaller diameter than that of the substrate, with the substrate while oscillating and rotating the polishing pad. Polishing of the substrate is terminated when a film thickness of the substrate has reached a predetermined target value. There is a method of measuring the film thickness of the substrate during polishing using an optical film-thickness measuring device provided in the substrate polishing apparatus. This optical film-thickness measuring device is configured to direct light onto a surface of the substrate, and determine a film thickness based on a spectral waveform of light reflected from the substrate.

However, since foreign matter, such as polishing liquid or polishing debris, are present on the surface of the substrate during polishing, such foreign matter may lower a transmittance of the light, when the film-thickness measuring device directs the light and receives the reflected light. As a result, it is difficult to measure the film thickness of the substrate during polishing with high accuracy.

SUMMARY

Therefore, there is provided a substrate polishing apparatus capable of measuring a film thickness of a substrate with high accuracy without lowering a transmittance of light when measuring the film thickness of the substrate being polished.

Embodiments, which will be described below, relate to a substrate polishing apparatus and a substrate polishing method, and more particularly to a substrate polishing apparatus and a substrate polishing method for measuring a film thickness of a substrate during polishing.

In an embodiment, there is provided a substrate polishing apparatus comprising: a stage configured to support a substrate and rotate the substrate with a surface of the substrate facing upward; a polishing head configured to hold a polishing pad having a polishing surface for polishing the substrate supported by the stage; a polishing-liquid supply nozzle configured to supply a polishing liquid onto the surface of the substrate; a film-thickness measuring head configured to irradiate a measurement area on the surface of the substrate on the stage with light and receive reflected light from the measurement area; a spectrum analyzer configured to generate a spectrum of the reflected light and determine a film thickness of the substrate from the spectrum; and a head nozzle to which the film-thickness measuring head is attached, wherein the head nozzle includes a first flow-passage system and a second flow-passage system each configured to form a flow of liquid across an optical path of the light and the reflected light, the first flow-passage system has an aperture located on the optical path, the second flow-passage system has a liquid outlet port and a liquid suction port located at both sides of the aperture.

In an embodiment, the liquid outlet port and the liquid suction port are arranged symmetrically with respect to the aperture.

In an embodiment, the aperture, the liquid outlet port, and the liquid suction port are located in a bottom surface of the head nozzle.

In an embodiment, the liquid outlet port is located upstream of the aperture and the liquid suction port in a rotating direction of the substrate.

In an embodiment, the first flow-passage system includes: a fluid chamber provided on the optical path; a first liquid supply flow-passage configured to supply liquid to the fluid chamber; a first liquid discharge flow-passage configured to discharge liquid from the fluid chamber; and the aperture which communicates with a lower end of the fluid chamber and can be close to the surface of the substrate, and the second flow-passage system includes: a second liquid supply flow-passage configured to supply liquid on the surface of the substrate; a second liquid discharge flow-passage configured to discharge liquid on the surface of the substrate; the liquid outlet port which communicates with the second liquid supply flow-passage and can be close to the surface of the substrate; and the liquid suction port which communicates with the second liquid discharge flow-passage and can be close to the surface of the substrate.

In an embodiment, both the liquid outlet port and the liquid suction port are larger than the aperture.

In an embodiment, the liquid suction port is larger than the liquid outlet port.

In an embodiment, the second flow-passage system further includes a liquid collecting groove which is coupled to the liquid suction port and can be close to the surface of the substrate, the liquid collecting groove is located upstream of the liquid suction port in a rotating direction of the substrate, and a width of the liquid collecting groove is larger than a width of the liquid suction port.

In an embodiment, there is provided a substrate polishing method comprising: supporting and rotating a substrate with a surface of the substrate facing upward; polishing the substrate by pressing a polishing pad having a polishing surface against the substrate while supplying a polishing liquid to the surface of the substrate; irradiating a measurement area on the surface of the substrate with light transmitted from a film-thickness measuring head through an aperture provided in a head nozzle located close to the surface of the substrate, while passing liquid through the aperture, supplying liquid onto the surface of the substrate from a liquid outlet port provided in the head nozzle, and sucking the liquid on the surface of the substrate through a liquid suction port provided in the head nozzle, the liquid outlet port and the liquid suction port being located at both sides of the aperture; receiving reflected light from the measurement area through the aperture by the film-thickness measuring head; and determining a film thickness of the substrate from a spectrum of the reflected light.

In an embodiment, flowing liquid through the aperture provided in the head nozzle is flowing liquid through a fluid chamber and the aperture, provided in the head nozzle, irradiating the measurement area on the surface of the substrate with light from the film-thickness measuring head through the aperture is irradiating the measurement area on the surface of the substrate with light from the film-thickness measuring head through the fluid chamber and the aperture, and receiving reflected light from the measurement area through the aperture by the film-thickness measuring head is receiving reflected light from the measurement area through the aperture and the fluid chamber by the film-thickness measuring head.

In an embodiment, the liquid outlet port and the liquid suction port are arranged symmetrically with respect to the aperture.

In an embodiment, the aperture, the liquid outlet port, and the liquid suction port are located in a bottom surface of the head nozzle.

In an embodiment, the liquid outlet port is located upstream of the aperture and the liquid suction port in a rotating direction of the substrate.

In an embodiment, both the liquid outlet port and the liquid suction port are larger than the aperture.

In an embodiment, the liquid suction port is larger than the liquid outlet port.

In an embodiment, the head nozzle has a liquid collecting groove coupled to the liquid suction port, the liquid collecting groove is located upstream of the liquid suction port in a rotating direction of the substrate, and a width of the liquid collecting groove is larger than a width of the liquid suction port.

In an embodiment, there is provided a substrate polishing apparatus comprising: a stage configured to support a substrate with a surface of the substrate facing upward; a polishing head configured to hold a polishing pad having a polishing surface for polishing the substrate supported by the stage; a polishing-liquid supply nozzle configured to supply a polishing liquid on a surface of the substrate; a film-thickness measuring head configured to irradiate a measurement area on the surface of the substrate on the stage with light and receive reflected light from the measurement area; a spectrum analyzer configured to generate a spectrum of the reflected light and determine a film thickness of the substrate from the spectrum; and a head nozzle to which the film-thickness measuring head is attached, the head nozzle including: a fluid chamber provided on an optical path of the light and the reflected light; a liquid supply flow-passage configured to supply liquid to the fluid chamber; a liquid discharge flow-passage configured to discharge liquid from the fluid chamber and an aperture which is provided on the optical path and can be close to the surface of the substrate, wherein a first connection between the liquid supply flow-passage and the fluid chamber is located at a lower portion of the fluid chamber, a second connection between the liquid discharge flow-passage and the fluid chamber is located at an upper portion of the fluid chamber, and the aperture communicates with a lower end of the fluid chamber and a width of the aperture is smaller than a width of the fluid chamber.

In an embodiment, the second connection is located at a lower end of the film-thickness measuring head.

In an embodiment, an upper surface of the liquid discharge flow-passage extending from the second connection is located higher than the lower end of the film-thickness measuring head.

In an embodiment, the width of the aperture is in a range of 1.0 mm to 2.0 mm.

In an embodiment, further comprises: a supply valve coupled to the liquid supply flow-passage; and a discharge valve coupled to the liquid discharge flow-passage, wherein the supply valve and the discharge valve are configured such that flow rate of liquid flowing in the liquid supply flow-passage is higher than flow rate of liquid flowing in the liquid discharge flow-passage.

In an embodiment, further comprises: a polishing-head moving mechanism configured to move the polishing head between a polishing position and a non-polishing position; a film-thickness measuring head moving mechanism configured to move the film-thickness measuring head between a measuring position and a non-measuring position; and an operation controller coupled to the polishing-head moving mechanism and the film-thickness measuring head moving mechanism, wherein the operation controller is configured to control the polishing-head moving mechanism and the film-thickness measuring head moving mechanism such that the polishing head and the film-thickness measuring head do not come into contact with each other.

In an embodiment, there is provided a substrate polishing method comprising: supporting a substrate with a surface of the substrate facing upward; polishing the substrate by pressing a polishing pad having a polishing surface against the substrate while supplying a polishing liquid to the surface of the substrate; bringing an aperture of a head nozzle close to the surface of the substrate; irradiating a measurement area on the surface of the substrate with tight transmitted from a film-thickness measuring head through a fluid chamber and the aperture, while supplying liquid from a liquid supply flow-passage to the fluid chamber of the head nozzle, and discharging the liquid from the fluid chamber through a liquid discharge flow-passage; receiving reflected light from the measurement area through the fluid chamber and the aperture by the film-thickness measuring head; and determining a film thickness of the substrate from a spectrum of the reflected light, wherein a first connection between the liquid supply flow-passage and the fluid chamber is located below a second connection between the liquid discharge flow-passage and the fluid chamber, and the aperture communicates with a lower end of the fluid chamber, and a width of the aperture is smaller than a width of the fluid chamber.

In an embodiment, the second connection is located at a lower end of the film-thickness measuring head.

In an embodiment, an upper surface of the liquid discharge flow-passage extending from the second connection is located higher than the lower end of the film-thickness measuring head.

In an embodiment, a distance from a lower end of the aperture to the surface of the substrate when the aperture is close to the surface of the substrate is in a range of 0.5 mm to 1.0 mm.

In an embodiment, flow rate of liquid flowing in the liquid supply flow-passage is higher than flow rate of liquid flowing in the liquid discharge flow-passage.

In an embodiment, further comprises polishing the substrate while moving the polishing head and the film-thickness measuring head so as not come into contact with each other and determining the film thickness of the substrate.

According to the above-described embodiments, the head nozzle includes the first flow-passage system and the second flow-passage system, and the liquid supply-discharge mechanism for these two separate systems removes the polishing liquid and the polishing debris existing on the optical path. Since the optical path is filled with a transparent liquid during measuring of the film thickness, the film thickness of the substrate being polished can be measured with high accuracy.

The liquid supplied onto the surface of the substrate from the liquid outlet port of the second flow-passage system flows along the surface of the substrate through the gap between the aperture of the first flow-passage system and the substrate, and the liquid is sucked in through the liquid suction port of the second flow-passage system. Since the polishing liquid and the polishing debris existing between the aperture and the substrate are removed by this flow of the liquid, the film thickness of the substrate being polished can be measured with high accuracy.

According to the above-described embodiments, the transparent liquid is supplied to the fluid chamber provided in the head nozzle of the film-thickness measuring device, and the transparent liquid is discharged from the fluid chamber, so that the transparent liquid is supplied through the aperture to remove foreign matter, such as polishing liquid, on the substrate, and the optical path is filled with the transparent liquid during measuring of the film-thickness. As a result, the film thickness of the substrate being polished can be measured with high accuracy.

According to the above-described embodiments, the flow rate of the liquid supplied from the head nozzle of the film-thickness measuring device is minimized, so that a decrease in a polishing performance due to dilution of the polishing liquid on the substrate can be prevented.

According to the above-described embodiments, since the first connection between the liquid supply flow-passage and the fluid chamber provided in the head nozzle of the film-thickness measuring device is located at the lower portion of the fluid chamber, a collision between the liquid flowing into the fluid chamber through the first connection and the liquid already existing in the fluid chamber is alleviated, and generation of bubbles due to the collision between the liquids can be reduced. In addition, since the second connection between the liquid discharge flow-passage and the fluid chamber is located at the upper portion of the fluid chamber, bubbles generated in the fluid chamber can be discharged quickly.

According to the above-described embodiments, the width of the fluid chamber at the first connection between the liquid supply flow-passage and the fluid chamber provided in the head nozzle of the film-thickness measuring device is smaller than the width of the fluid chamber at the portion facing the lower end of the film-thickness measuring head. As a result, the bubbles generated in the fluid chamber are dispersed outside of the optical path without staying on the optical path during measuring of the film thickness. Since the second connection is located at the lower end of the film-thickness measuring head, the bubbles are discharged quickly without staying in the fluid chamber.

DESCRIPTION OF EMBODIMENTS

Figure 1:
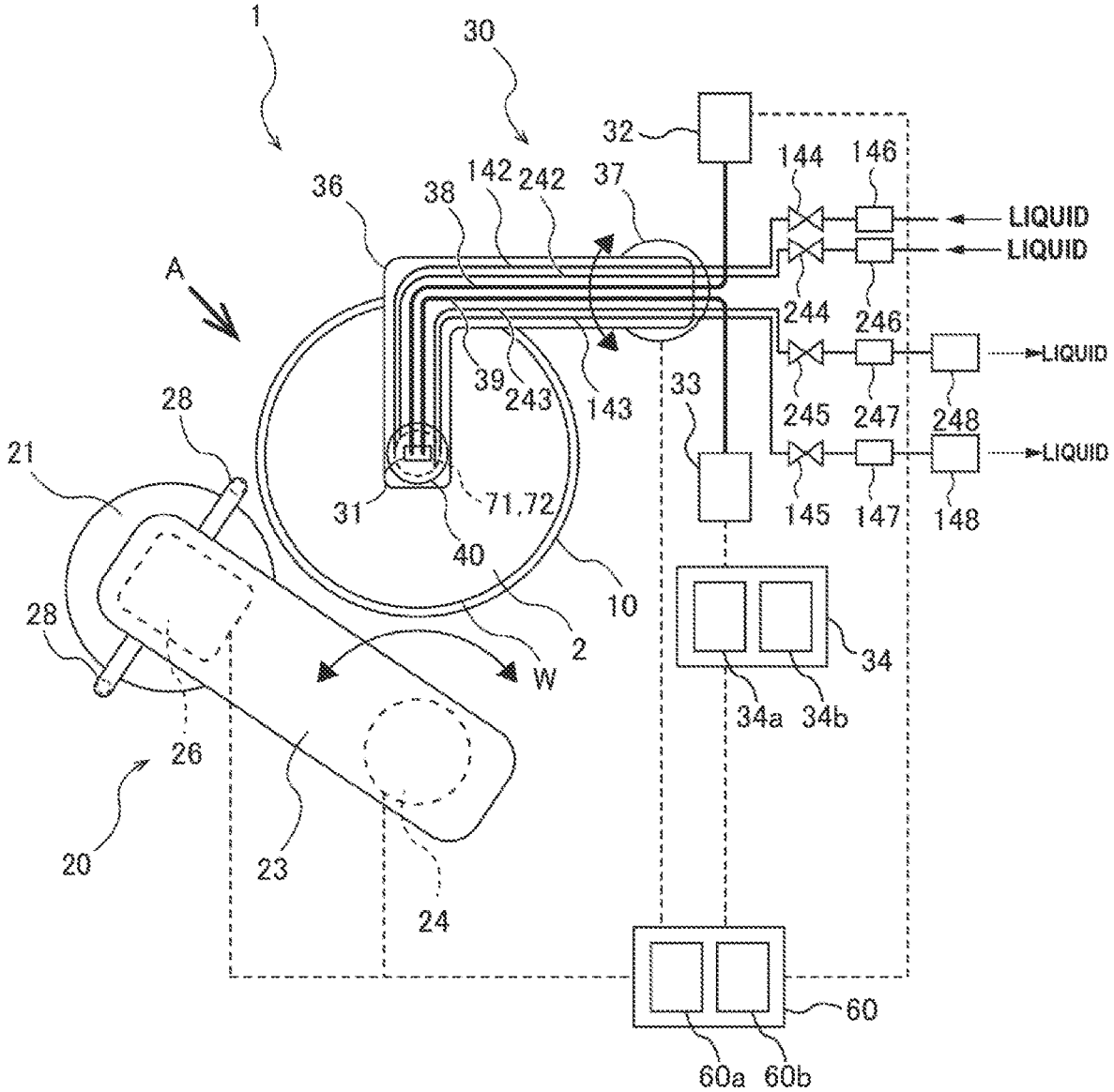
FIG. 1 is a plan view showing an embodiment of a substrate polishing apparatus.

Embodiments will be described below with reference to the drawings. Identical or corresponding elements are denoted by the same reference numerals, and their repetitive explanations will be omitted.

Figure 2:
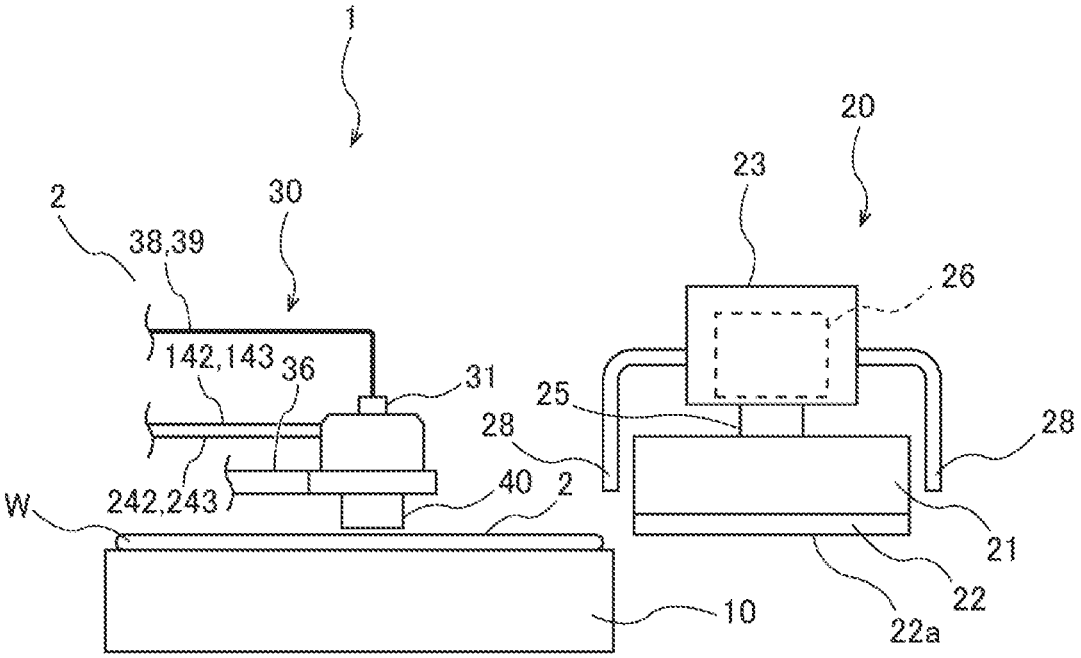
FIG. 2 is a side view of the substrate polishing apparatus shown in FIG. 1 as viewed in a direction of an arrow A.

FIG. 1 is a plan view showing an embodiment of a substrate polishing apparatus 1. FIG. 2 is a side view of the substrate polishing apparatus 1 shown in FIG. 1 as viewed in a direction of an arrow A. As shown in FIGS. 1 and 2, the substrate polishing apparatus 1 includes a stage 10 configured to support a substrate W, a polishing unit 20 configured to polish the substrate W, and a film-thickness measuring device configured to measure a film thickness of the substrate W. An example of the substrate W is a wafer used for manufacturing of a semiconductor device. In embodiments described below, the substrate W is of a circular shape, but may have a quadrangular shape.

The stage 10 supports the substrate W to be polished with a polishing-target surface 2 facing upward. The stage 10 has through-holes (not shown), and the substrate W is supported by vacuum suction through the holes. The stage 10 is coupled to a stage rotating mechanism (not shown), such as a motor, and the stage rotating mechanism is configured to rotate the stage 10 and the substrate W.

The polishing unit 20 includes a polishing head 21, a polishing-head arm 23, a polishing-head moving mechanism 24, a rotating shaft 25, a polishing-head rotating mechanism 26, and polishing-liquid supply nozzles 28. The polishing head 21 holds a polishing pad 22 having a polishing surface 22*a*, and is coupled to the polishing-head arm 23 via the rotating shaft 25 extending in a height direction. The rotating shaft 25 is coupled to the polishing-head rotating mechanism 26 including a motor, etc. The polishing-head rotating mechanism 26 is configured to rotate the polishing head 21 and the polishing pad 22 together with the rotating shaft 25 around the rotating shaft 25.

The polishing-head arm 23 is further coupled to the polishing-head moving mechanism 24, and the polishing-head moving mechanism 24 causes the polishing-head arm 23 to oscillate in directions of arrows to move the polishing head 21 between a polishing position and a non-polishing position. The polishing position is a position where the polishing head 21 can polish the substrate W, i.e., a position where at least a part of the polishing head 21 is located above the substrate W on the stage 10. The non-polishing position is a position where the polishing head 21 cannot polish the substrate W, i.e., a position where the entire polishing head 21 is located outside the substrate W on the stage 10. In FIGS. 1 and 2, the polishing head 21 is located at the non-polishing position.

The two polishing-liquid supply nozzles 28 are coupled to the polishing-head arm 23, and tips of the polishing-liquid supply nozzles 28 are arranged at both sides of the polishing head 21 in a moving direction of the polishing head 21 such that the polishing head 21 is located between the tips of the polishing-liquid supply nozzles 28. The two polishing-liquid supply nozzles 28 are configured to supply polishing liquid containing abrasive grains, such as silica ($SiO_2$), or cleaning water onto the surface of the substrate W.

Operations of the stage rotating mechanism and the polishing unit 20 are controlled by an operation controller 60. The operation controller 60 is electrically connected to the stage rotating mechanism, the polishing-head moving mechanism 24, and the polishing-head rotating mechanism 26. The operations of the stage rotating mechanism, the polishing-head moving mechanism 24, and the polishing-head rotating mechanism 26 are controlled by the operation controller 60.

The operation controller 60 is composed of at least one computer. The operation controller 60 includes a memory 60*a* storing programs therein for operating the substrate polishing apparatus 1, and an arithmetic device 60*b* configured to perform arithmetic operations according to instructions contained in the programs. The memory 60*a* includes a main memory, such as a random-access memory (RAM), and an auxiliary memory, such as a hard disk drive (HDD) or a solid state drive (SSD). Examples of the arithmetic device 60*b* include a CPU (central processing unit) and a GPU (graphic processing unit). However, the specific configuration of the operation controller 60 is not limited to these examples.

The substrate W is polished as follows. The operation controller 60 instructs the stage 10 to rotate the substrate W while the polishing liquid is supplied from the polishing-liquid supply nozzles 28. The operation controller 60 instructs the polishing-head moving mechanism 24 to oscillate the polishing head 21 above the substrate W supported by the stage 10. While the polishing pad 22 held by the polishing head 21 is rotated by the polishing-head rotating mechanism 26, the polishing head 21 presses the polishing surface 22*a* of the polishing pad 22 against the polishing-target surface 2 of the substrate W in the presence of the polishing liquid on the substrate W. The polishing-target surface 2 of the substrate W is polished by a chemical action of the polishing liquid and a mechanical action of the abrasive grains contained in the polishing liquid and/or the polishing pad 22.

The film-thickness measuring device 30 is an optical film-thickness measuring device, which includes a light source 32, a spectrometer 33, a spectrum analyzer 34, a film-thickness measuring head 31, a head nozzle 40, and a film-thickness measuring head arm 36, and a film-thickness measuring head moving mechanism 37. The film-thickness measuring head 31 has distal ends of a light-emitting optical fiber cable 38 and a light-receiving optical fiber cable 39. The light source 32, which is configured to emit light, is coupled to the light-emitting optical fiber cable 38. The spectrometer 33 is coupled to the light-receiving optical fiber cable 39. The light source 32 and the spectrometer 33 are coupled to the spectrum analyzer 34.

One end of the film-thickness measuring head arm 36 is coupled to the film-thickness measuring head 31, and the other end of the film-thickness measuring head arm 36 is coupled to the film-thickness measuring head moving mechanism 37. The film-thickness measuring head moving mechanism 37 oscillates the film-thickness measuring head arm 36 in directions of arrows to move the film-thickness measuring head 31 between a measuring position and a non-measuring position. The measuring position is a position where the film-thickness measuring head 31 can measure the film thickness of the substrate W, i.e., a position where the film-thickness measuring head 31 is located above the substrate W on the stage 10. The non-measuring position is a position where the film-thickness measuring head 31 cannot measure the film thickness of the substrate W, i.e., a position where the film-thickness measuring head 31 is located outside the substrate W on the stage 10. In FIGS. 1 and 2, the film-thickness measuring head 31 is located at the measuring position. The film-thickness measuring head moving mechanism 37 is electrically connected to the operation controller 60, and an operation of the film-thickness measuring head moving mechanism 37 is controlled by the operation controller 60.

The film-thickness measuring head 31 including the distal end of the light-emitting optical fiber cable 38 and the distal end of the light-receiving optical fiber cable 39 is attached to the head nozzle 40. The head nozzle 40 includes a first flow-passage system 71 and a second flow-passage system 72, which will be described in detail later. The first flow-passage system 71 is coupled to a first liquid supply line 142 configured to supply liquid to the head nozzle 40 and a first liquid discharge line 143 configured to discharge liquid from the head nozzle 40. The second flow-passage system 72 is coupled to a second liquid supply line 242 configured to supply liquid to the head nozzle 40 and a second liquid discharge line 243 configured to discharge liquid from the head nozzle 40. The first liquid supply line 142 and the second liquid supply line 242 are coupled to a liquid supply source (not shown), respectively. The liquid supplied to the head nozzle 40 is, for example, pure water. The liquid may be a transparent liquid, and may be, for example, a KOH solution used as a polishing liquid.

A first supply valve 144 and a flow meter 146 are attached to the first liquid supply line 142, and a second supply valve 244 and a flow meter 246 are attached to the second liquid supply line 242. A first discharge valve 145, a flow meter 147, and a liquid pump 148, such as an ejector, are attached to the first liquid discharge line 143. A second discharge valve 245, a flow meter 247, and a liquid pump 248, such as an ejector, are attached to the second liquid discharge line 243. The first supply valve 144, the second supply valve 244, the first discharge valve 145, and the second discharge valve 245 may be manually operated. Alternatively, the first supply valve 144, the second supply valve 244, the first discharge valve 145, and the second discharge valve 245 are coupled to the operation controller 60, and operations of the first supply valve 144, the second supply valve 244, the first discharge valve 145, and the second discharge valve 245 may be controlled by the operation controller 60. The head nozzle 40 will be described in detail later.

Figure 3:
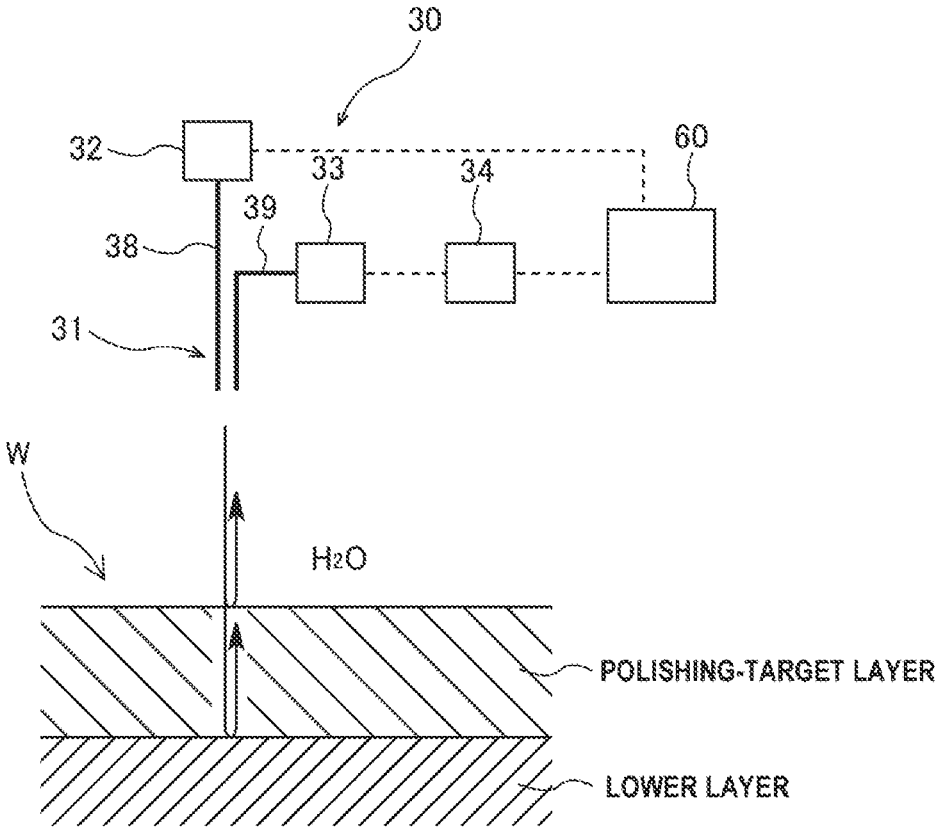
FIG. 3 is a schematic diagram illustrating a principle of an optical film-thickness measuring device.

FIG. 3 is a schematic diagram illustrating a principle of the optical film-thickness measuring device 30. In an example shown in FIG. 3, the substrate W has a lower layer and a polishing-target layer formed on the lower layer. The polishing-target layer is, for example, a silicon layer or an insulating film. The film-thickness measuring head 31 has the distal ends of the light-emitting optical fiber cable 38 and the light-receiving optical fiber cable 39, and is oriented toward the surface of the substrate W. In the present embodiment, the head nozzle 40 is attached to the film-thickness measuring head 31, but in FIG. 3, the configuration of the head nozzle 40 is omitted for simplifying descriptions.

The light emitted by the light source 32 is transmitted to the film-thickness measuring head 31 through the light-emitting optical fiber cable 38, and is directed to the surface of the substrate W from the film-thickness measuring head 31 including the distal end of the light-emitting optical fiber cable 38. The light is reflected off the substrate W, and the reflected light from the substrate W is received by the film-thickness measuring head 31 including the distal end of the light-receiving optical fiber cable 39 and is further transmitted to the spectrometer 33 through the light-receiving optical fiber cable 39. The spectrometer 33 decomposes the reflected light according to its wavelengths and measures an intensity of the reflected light at each of the wavelengths. The intensity measurement data of the reflected light is transmitted to the spectrum analyzer 34.

The spectrum analyzer 34 is configured to produce a spectrum of the reflected light from the intensity measurement data of the reflected light. This spectrum of the reflected light is expressed as a line graph (i.e., a spectral waveform) indicating a relationship between the wavelength and the intensity of the reflected light. The intensity of the reflected light can also be represented by a relative value, such as a reflectance or a relative reflectance.

The light, which is cast on the substrate W, is reflected off an interface between a medium water in the example in FIG. 3) and the polishing-target layer and an interface between the polishing-target layer and the lower layer. Light waves from these interfaces interfere with each other. The manner of interference between the light waves varies according to the thickness of the polishing-target layer (i.e., a length of an optical path). As a result, the spectrum, produced from the reflected light from the substrate W, varies according to the thickness of the polishing-target layer. The spectrum analyzer 34 determines the film thickness of the substrate W based on optical information contained in the spectrum of the reflected light.

Figure 4:
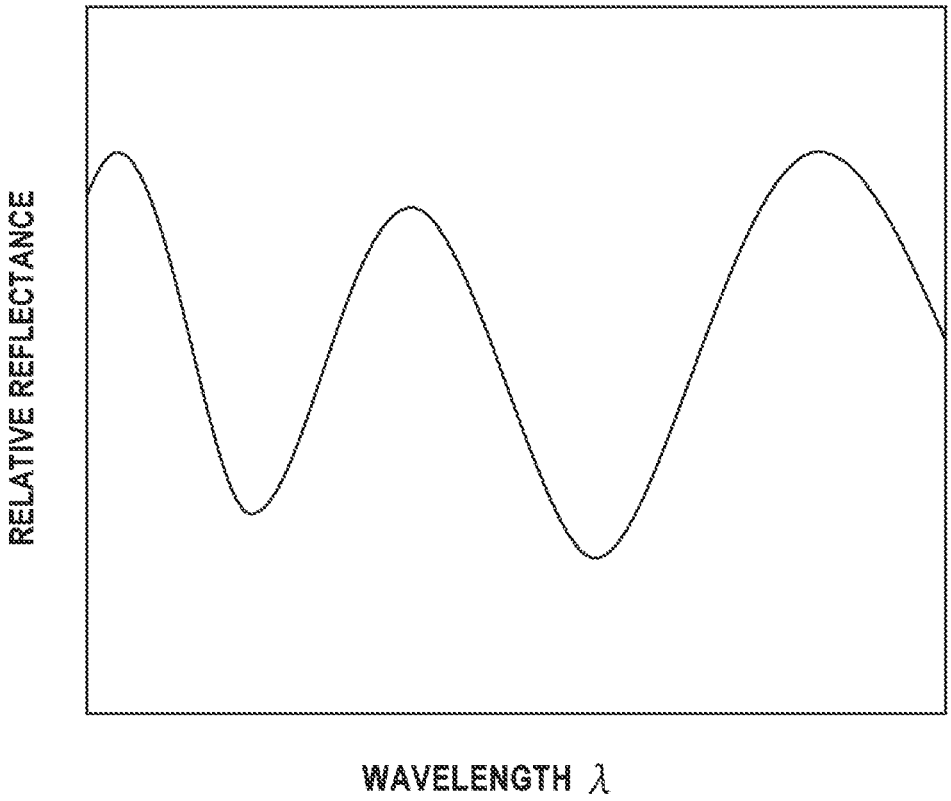
FIG. 4 is a diagram showing an example of a spectral waveform generated by a spectrum analyzer.

FIG. 4 is a diagram showing an example of a spectrum generated by the spectrum analyzer 34. In FIG. 4, horizontal axis represents the wavelength of the reflected light from the substrate W, and vertical axis represents a relative reflectance derived from the intensity of the reflected light. The relative reflectance is an index that represents the intensity of the reflected light. The relative reflectance is a ratio of the intensity of the light to a predetermined reference intensity. By dividing the intensity of the light (i.e., the actually measured intensity) at each wavelength by a predetermined reference intensity, unwanted noises, such as a variation in the intensity inherent in an optical system or the light source of the apparatus, are removed from the actually measured intensity. In the example shown in FIG. 4, the spectrum of the reflected light is a spectral waveform showing the relationship between the relative reflectance and the wavelength of the reflected light. The spectrum of the reflected light may be a spectral waveform showing a relationship between the intensity itself of the reflected light and the wavelength of the reflected light.

The reference intensity is an intensity of light measured in advance at each of the wavelength. The relative reflectance is calculated at each of the wavelength. Specifically, the relative reflectance is determined by dividing the intensity of the light (the actual intensity) at each wavelength by the corresponding reference intensity. The reference intensity is obtained by directly measuring the intensity of light emitted from the film-thickness measuring head 31, or by irradiating a mirror with light from the film-thickness measuring head 31 and measuring the intensity of reflected light from the mirror. Alternatively, the reference intensity may be an intensity of a reflected light from a silicon substrate (bare substrate) with no film thereon measured by the spectrometer 33 when the silicon substrate is being water-polished on the stage 10 in the presence of water, or when the silicon substrate (bare substrate) is placed on the stage 10.

In the actual polishing process, a dark level (which is a background intensity obtained under the condition that the light is cut off) is subtracted from the actually measured intensity to determine a corrected actually measured intensity. Further, the dark level is subtracted from the reference intensity to determine a corrected reference intensity. Then the relative reflectance is calculated by dividing the corrected actually measured intensity by the corrected reference intensity. Specifically, the relative reflectance R(λ) can be calculated by using $$R(\lambda) = \frac{E(\lambda) - D(\lambda)}{B(\lambda) - D(\lambda)} \tag{1}$$

where, λ is wavelength of the light reflected from the substrate W, E(λ) is the intensity at the wavelength λ, B(λ) is the reference intensity at the wavelength λ, and D(λ) is the background intensity (i.e., dark level) at the wavelength λ measured under the condition that the light is cut off.

The spectrum analyzer 34 determines the film thickness of the substrate W from the spectrum of the reflected light from the substrate W. Known methods can be used as a method of determining the film thickness from the spectrum of the reflected light. For example, there is a method of determining a film thickness from a frequency spectrum obtained by performing a Fourier transform process (typically, a fast Fourier transform process) on the spectrum of the reflected light, or a method of determining a film thickness associated with a reference spectrum having the closest shape to the spectrum of the reflected light among a plurality of reference spectra.

The spectrum analyzer 34 includes a memory 34*a* (see FIG. 1) storing a program therein for operating the determination of the thickness of the polishing-target layer, and an arithmetic device 34*b* (see FIG. 1) configured to perform an arithmetic operation according to an instruction contained in the program. The spectrum analyzer 34 is composed of at least one computer. The memory 34*a* includes a main memory, such as a random-access memory (RAM), and an auxiliary memory, such as a hard disk drive (HDD) or a solid state drive (SSD). Examples of the arithmetic device 34*b* include a CPU (central processing unit) and a GPU (graphic processing unit). However, the specific configuration of the spectrum analyzer 34 is not limited to these examples.

The spectrum analyzer 34 transmits the determined thickness of the polishing-target layer to the operation controller 60 (see FIG. 3). The operation controller 60 determines a polishing end point based on the determined thickness of the polishing-target layer, and controls the operation of the polishing unit 20. For example, the operation controller 60 determines the polishing end point at which the determined thickness of the polishing-target layer reaches a target value. In one embodiment, the polishing end point may be determined by measuring a total thickness of the polishing-target layer and the lower layer. The spectrum analyzer 34 for determining the thickness of the polishing-target layer and the operation controller 60 for controlling the operation of polishing the substrate W may be configured integrally. In this specification, examples of the film thickness of the substrate W include the thickness of the polishing-target layer, the total thickness of the polishing-target layer and the lower layer, etc.

Figure 5A:
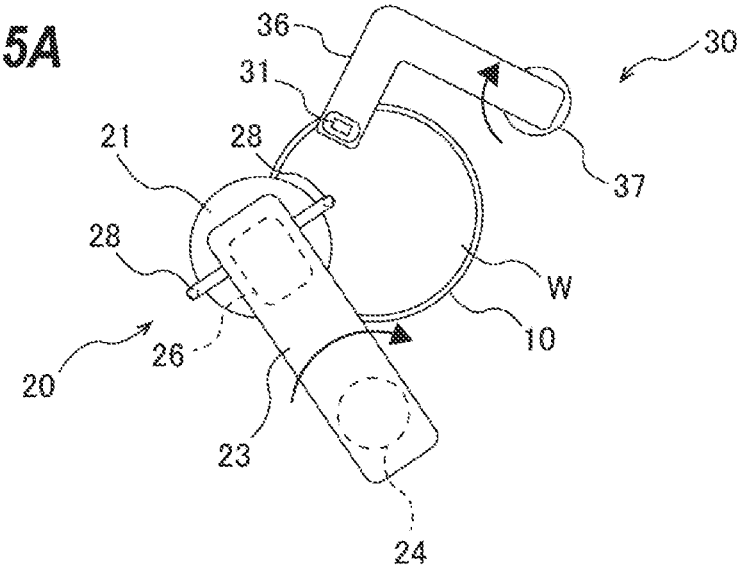
FIG. 5A is a diagram illustrating operations of a polishing unit and the film-thickness measuring device.
Figure 5B:
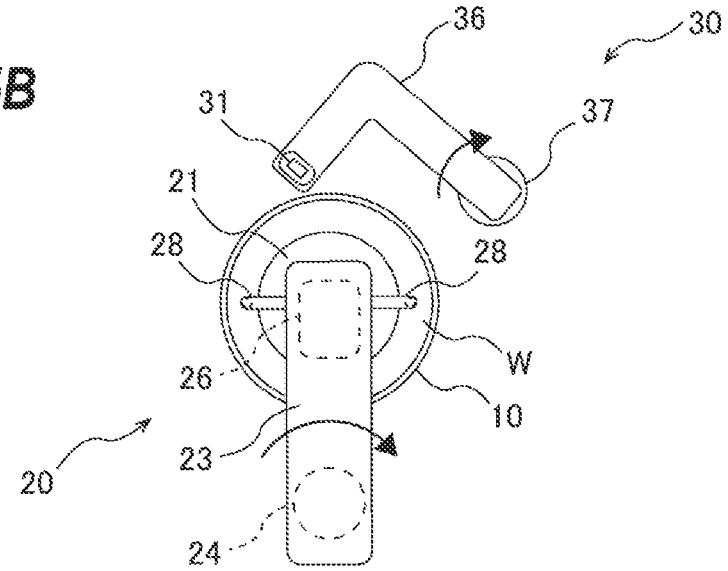
FIG. 5B is a diagram illustrating operations of the polishing unit and the film-thickness measuring device.
Figure 5C:
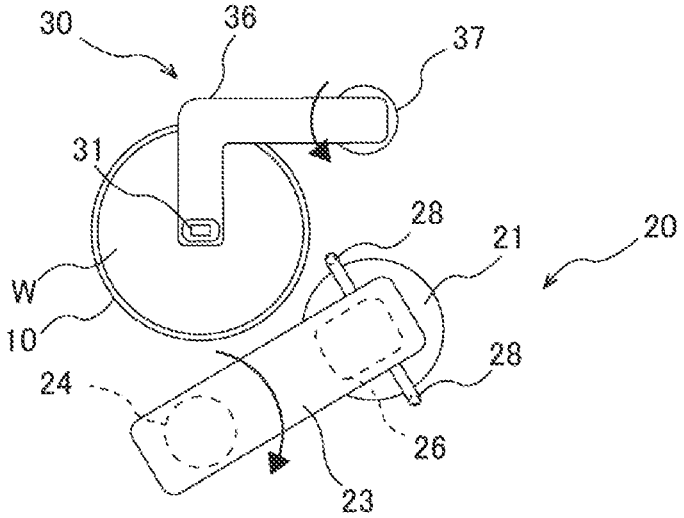
FIG. 5C is a diagram illustrating operations of the polishing unit and the film-thickness measuring device.

FIGS. 5A to 5C are diagrams illustrating operations of the polishing unit 20 and the film-thickness measuring device 30. The polishing head 21 of the polishing unit 20 and the film-thickness measuring head 31 of the film-thickness measuring device 30 are configured to move in conjunction with each other. Specifically, the operation controller 60 controls the polishing-head moving mechanism 24 and the film-thickness measuring head moving mechanism 37 such that the polishing head 21 and the film-thickness measuring head 31 do not come into contact with each other.

FIG. 5A shows that a part of the polishing head 21 is located above the substrate W on the stage 10 and the film-thickness measuring head 31 is located above the substrate W on the stage 10. Specifically, the polishing head 21 is located at the polishing position, and the film-thickness measuring head 31 is located at the measuring position. While the polishing-head moving mechanism 24 moves the polishing-head arm 23 in a direction in which the polishing head 21 moves toward the center of the substrate W, as shown by an arrow the polishing head 21 presses the polishing pad 22 (see FIG. 2) against the substrate W, thereby polishing the substrate W. More specifically, the polishing head 21 polishes the substrate W by pressing the polishing pad 22 against the substrate W while moving in a radial direction of the substrate W. The substrate polishing apparatus 1 may include side stages (not shown) arranged at both sides of the stage 10 in the moving direction of the polishing head 21. The side stages are configured to support the polishing head 21 when located outside the stage 10. As a result, the substrate W can be polished uniformly without a pressing force of the polishing head 21 being concentrated on a periphery of the substrate W.

The film-thickness measuring head 31 measures the film thickness of the substrate W while the film-thickness measuring head moving mechanism 37 moves the film-thickness measuring head arm 36 in a direction in which the film-thickness measuring head 31 moves toward the outside of the substrate W, as shown by an arrow. More specifically, the film-thickness measuring device 30 measures the film thickness of the substrate W while the film-thickness measuring head 31 moves in the radial direction of the substrate W. The film-thickness measuring device 30 may measure the film thickness of the substrate W at predetermined time intervals, or may measure the film thickness at predetermined measuring positions on the substrate W.

FIG. 5B shows that the polishing head 21 is located above the center of the substrate W on the stage 10 and the film-thickness measuring head 31 is located outside the substrate W on the stage 10. Specifically, the polishing head 21 is located at the polishing position, while the film-thickness measuring head 31 is located at the non-measuring position. While the polishing-head moving mechanism 24 moves the polishing-head arm 23 such that the polishing head 21 moves across the substrate W as shown by an arrow, the polishing head 21 presses the polishing pad 22 (see FIG. 2) against the substrate W, thereby polishing the substrate W. The film-thickness measuring head moving mechanism 37 moves the film-thickness measuring head arm 36 in a direction in which the film-thickness measuring head 31 moves further outward of the substrate W, as shown by an arrow. Since the film-thickness measuring head 31 is located at the non-measuring position, the film thickness of the substrate W is not measured.

FIG. 5C shows that the polishing head 21 is located outside the substrate W on the stage 10 and the film-thickness measuring head 31 is located above the center of the substrate W on the stage 10. Specifically, the polishing head 21 is located at the non-polishing position, while the film-thickness measuring head 31 is located at the measuring position. The polishing-head moving mechanism 24 moves the polishing-head arm 23 in a direction in which the polishing head 21 moves further outward of the substrate W, as shown by an arrow. Since the polishing head 21 is located at the non-polishing position, the substrate W is not polished. The film-thickness measuring head 31 measures the film thickness of the substrate W while the film-thickness measuring head moving mechanism 37 moves the film-thickness measuring head arm 36 in a direction in which the film-thickness measuring head 31 moves across the substrate W, as shown by an arrow. More specifically, the film-thickness measuring device 30 measures the film thickness of the substrate W while the film-thickness measuring head 31 moves in the radial direction of the substrate W. The film-thickness measuring device 30 may measure the film thickness of the substrate W at predetermined time intervals, or may measure the film thickness at predetermined measuring positions on the substrate W.

As shown in FIGS. 5A to 5C, each of the polishing head 21 and the film-thickness measuring head 31 oscillates in an orbit passing through the center of the substrate W on the stage 10, while the polishing head 21 and the film-thickness measuring head 31 move so as not to come into contact with each other.

Figure 6:
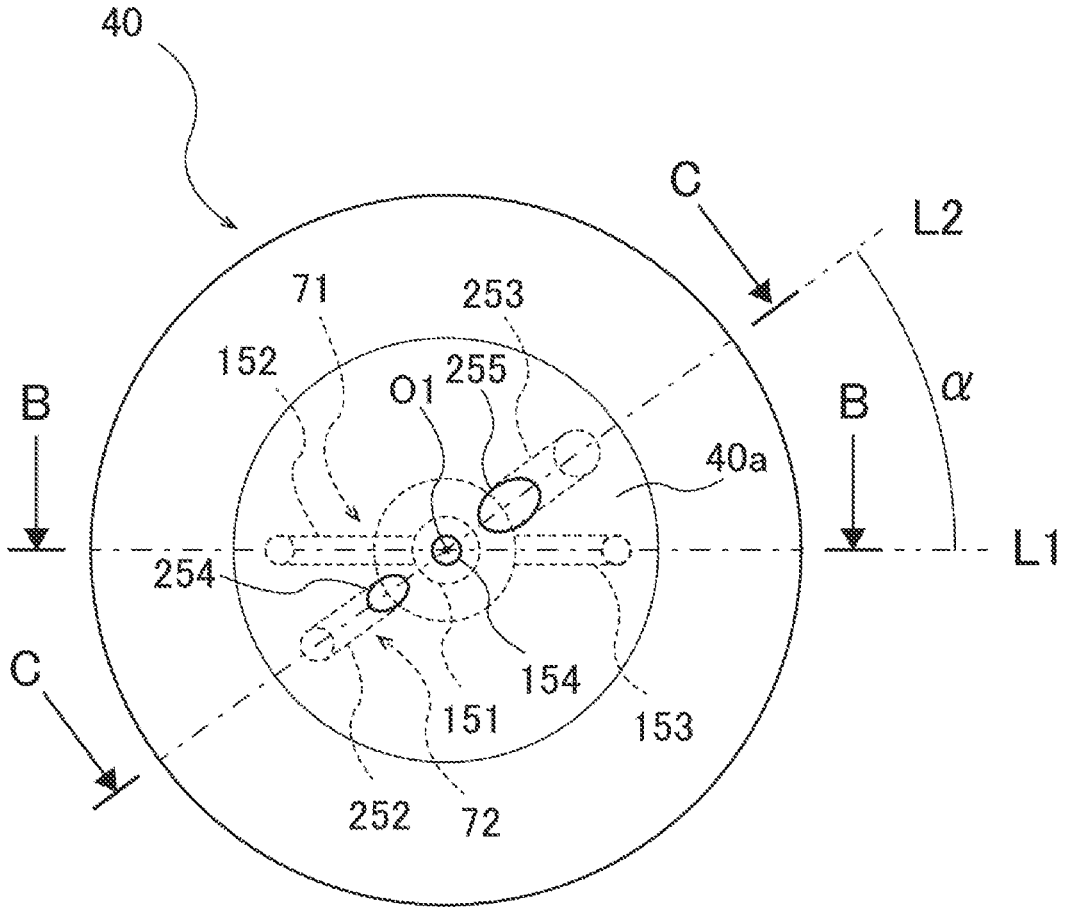
FIG. 6 is a diagram showing an arrangement of a first flow-passage system and a second flow-passage system when a head nozzle is viewed from below.

Next, details of the head nozzle 40 will be described. FIG. 6 is a diagram showing an arrangement of the first flow-passage system 71 and the second flow-passage system 72 when the head nozzle 40 is viewed from below. The head nozzle 40 includes the first flow-passage system 71 and the second flow-passage system 72 each configured to form a flow of liquid across an optical path of the light from the film-thickness measuring head 31 and the reflected light from the substrate W. The first flow-passage system 71 and the second flow-passage system 72 are two independent flow-passage systems configured to form two independent flows of liquid.

The first flow-passage system 71 includes a fluid chamber 151, a first liquid supply flow-passage 152, a first liquid discharge flow-passage 153, and an aperture 154. The second flow-passage system 72 includes a second liquid supply flow-passage 252, a second liquid discharge flow-passage 253, a liquid outlet port 254, and a liquid suction port 255.

The first flow-passage system 71 and the second flow-passage system 72 are located on two lines L1 and L2 (imaginary lines indicated by alternate long and short dash lines), respectively, intersecting at the central point O1 of the head nozzle 40 as viewed from an axial direction of the head nozzle 40. The first flow-passage system 71 and the second flow-passage system 72 are out of alignment by a predetermined angle α around the central point O1 of the head nozzle 40. Specifically, the fluid chamber 151, the first liquid supply flow-passage 152, the first liquid discharge flow-passage 153, and the aperture 154 of the first flow-passage system 71 are located away from the second liquid supply flow-passage 252, the second liquid discharge flow-passage 253, the liquid outlet port 254, and the liquid suction port 255 of the second flow-passage system 72. The predetermined angle α between the two lines L1 and L2 is, e.g., 30 degrees, but the predetermined angle α is not limited to this example.

Figure 7:
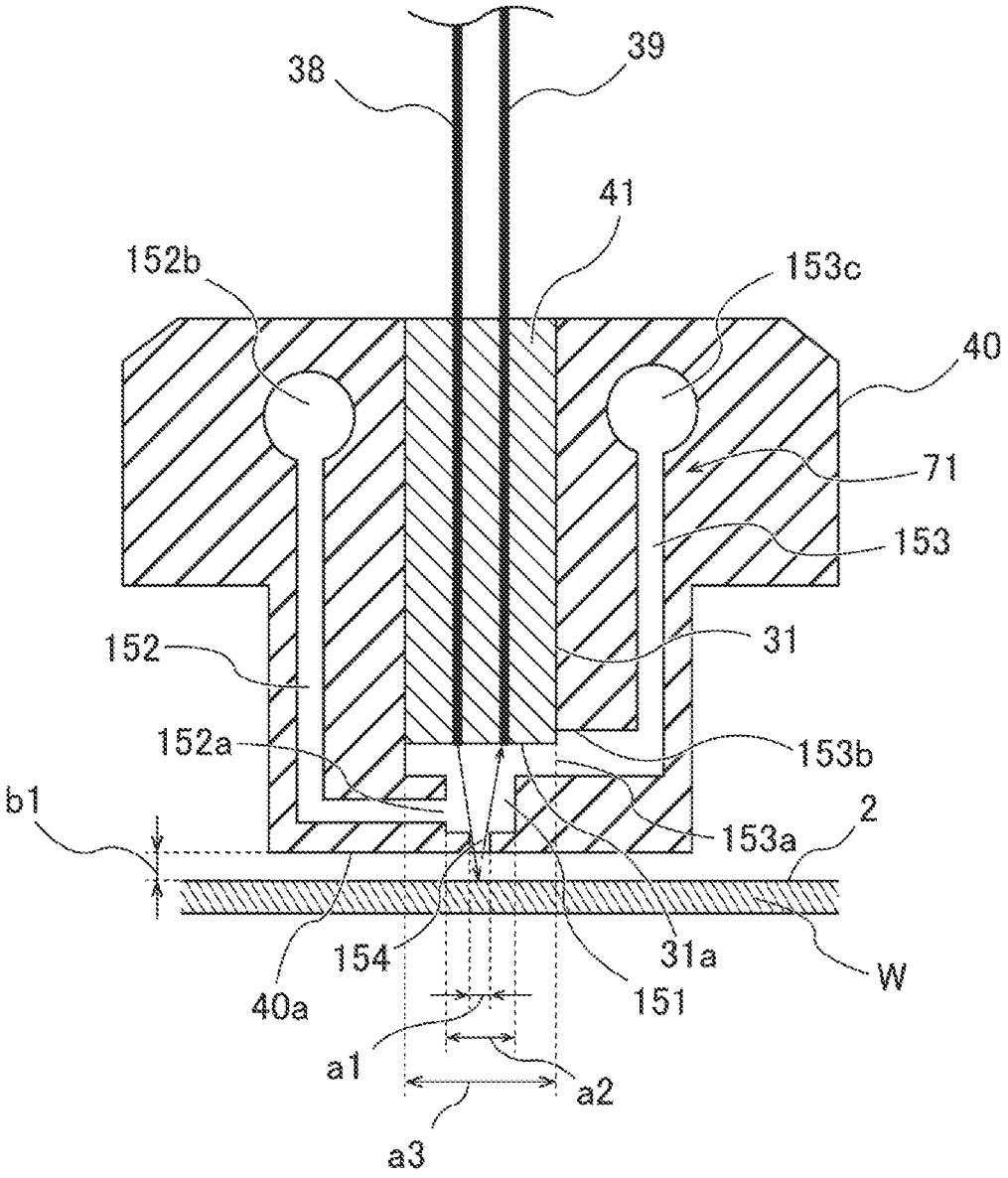
FIG. 7 is a cross-sectional view taken along line B-B of FIG. 6 schematically showing an embodiment of a first flow-passage system.

Hereinafter, details of configurations of the first flow-passage system 71 and the second flow-passage system 72 will be described. FIG. 7 is a cross-sectional view taken along line B-B of FIG. 6 schematically showing an embodiment of the first flow-passage system 71 of the head nozzle 40. The film-thickness measuring head 31 has the distal ends of the light-emitting optical fiber cable 38 and the light-receiving optical fiber cable 39, and a fiber holder 41 holding these distal ends. The head nozzle 40 has a shape that covers the end portion of the film-thickness measuring head 31. The first flow-passage system 71 of the head nozzle 40 has the fluid chamber 151, the first liquid supply flow-passage 152, the first liquid discharge flow-passage 153, and the aperture 154. The fluid chamber 151 is provided on the optical path of the light emitted from the film-thickness measuring head 31 to the surface of the substrate W and the reflected light from the substrate W to be received by the film-thickness measuring head 31. A lower end 31*a* of the film-thickness measuring head 31 faces the fluid chamber 151.

The first liquid supply flow-passage 152 and the first liquid discharge flow-passage 153 are coupled to the fluid chamber 151. The first liquid supply flow-passage 152 is coupled to the first liquid supply line 142 (see FIG. 1) at a first line connection 152*b*. The first liquid discharge flow-passage 153 is coupled to the first liquid discharge line 143 (see FIG. 1) at a second line connection 153*c*. A first connection 152*a* between the first liquid supply flow-passage 152 and the fluid chamber 151 is located lower than a second connection 153*a* between the first liquid discharge flow-passage 153 and the fluid chamber 151. More specifically, the first connection 152*a* between the first liquid supply flow-passage 152 and the fluid chamber 151 is located at a lower portion of the fluid chamber 151, while the second connection 153*a* between the first liquid discharge flow-passage 153 and the fluid chamber 151 is located at an upper portion of the fluid chamber 151.

Since the first connection 152*a* between the first liquid supply flow-passage 152 and the fluid chamber 151 is located at the lower portion of the fluid chamber 151, a collision between liquid flowing into the fluid chamber 151 through the first connection 152*a* and liquid already existing in the fluid chamber 151 is alleviated, and generation of bubbles due to the collision between the liquids can be reduced. In addition, since the second connection 153*a* between the first liquid discharge flow-passage 153 and the fluid chamber 151 is located at the upper portion of the fluid chamber 151, bubbles generated in the fluid chamber 151 can be discharged quickly through the first liquid discharge flow-passage 153.

The aperture 154 is provided on the optical path of the light emitted from the film-thickness measuring head 31 to the surface of the substrate W and the reflected light from the substrate W to be received by the film-thickness measuring head 31. The aperture 154 communicates with a lower end of the fluid chamber 151, and a width at of the aperture 154 is smaller than a width a2 of the fluid chamber 151. As a result, the bubbles generated in the fluid chamber 151 are dispersed to the upper portion of the fluid chamber 151 without staying in the aperture 154. In one embodiment, the width a1 of the aperture 154 is in a range of 1.0 mm to 2.0 mm. This is to minimize flow rate of liquid flowing out from the fluid chamber 151 through the aperture 154 to prevent dilution of the polishing liquid on the substrate W, and to ensure the optical path for the light emitted from the film-thickness measuring head 31 and the reflected light from the substrate W.

The aperture 154 is located in a bottom surface 40*a* of the head nozzle 40 and the aperture 154 can be close to the surface of the substrate W so as to face the surface of the substrate W in order to measure the film thickness of the substrate W. In one embodiment, a distance b1 from a lower end of the aperture 154 to the surface of the substrate W, i.e., a distance b1 from the bottom surface 40*a* of the head nozzle 40 to the polishing-target surface 2, is in a range of 0.5 mm to 1.0 mm. This is also to minimize the flow rate of the liquid flowing out from the fluid chamber 151 through the aperture 154 to prevent dilution of the polishing liquid on the substrate W.

The light-emitting optical fiber cable 38 and the light-receiving optical fiber cable 39 may be a bundle type in which a plurality of light-receiving optical fiber cables 39 are arranged and bundled on outside of a plurality of light-emitting optical fiber cables 38. Alternatively, the light-emitting optical fiber cable 38 and the light-receiving optical fiber cable 39 may not be bundled.

The width a2 of a portion of the fluid chamber 151 at a position of the first connection 152*a* between the first liquid supply flow-passage 152 and the fluid chamber 151 is smaller than a width a3 of a portion of the fluid chamber 151 facing the lower end 31*a* of the film-thickness measuring head 31. As a result, the bubbles generated in the fluid chamber 151 are dispersed outwardly of the optical path without staying on the optical path during measuring of the film thickness. The second connection 153*a* is located at the lower end of the film-thickness measuring head 31. More specifically, an upper surface 153*b* of the first liquid discharge flow-passage 153 extending from the second connection 153*a* is located higher than the lower end of the film-thickness measuring head 31. With such an arrangement, the bubbles can be discharged quickly through the first liquid discharge flow-passage 153 without staying in the fluid chamber 151.

When the first supply valve 144 (see FIG. 1) is opened, liquid flowing in the first liquid supply line 142 is supplied into the fluid chamber 151 through the first liquid supply flow-passage 152. The liquid supplied to the fluid chamber 151 is supplied to the polishing-target surface 2 of the substrate W through the aperture 154. When the first discharge valve 145 (see FIG. 1) is opened, the liquid in the fluid chamber 151 flows through the first liquid discharge flow-passage 153 into the first liquid discharge line 143, and is discharged outside the first liquid discharge line 143 by the liquid pump 148. The first supply valve 144 and the first discharge valve 145 are configured such that flow rate of the liquid flowing in the first liquid supply flow-passage 152 is higher than flow rate of the liquid flowing in the first liquid discharge flow-passage 153.

The liquid supplied from the first liquid supply line 142 is, for example, pure water. The liquid may be a transparent liquid, and may be, for example, a KOH solution used as a polishing liquid. When the first supply valve 144 and the first discharge valve 145 are opened, the fluid chamber 151 is filled with the liquid, and the liquid is supplied to the substrate W to remove the polishing liquid and the polishing debris existing on the substrate W. Since the optical path is filled with the transparent liquid during measuring of the film thickness, the film thickness of the substrate W being polished can be measured with high accuracy. The first supply valve 144 and the first discharge valve 145 may be opened at all times during polishing of the substrate W regardless of the position of the film-thickness measuring head 31, or may be opened only when the film-thickness measuring head 31 is in the measuring position.

In one embodiment, the flow rate of the liquid flowing in the first liquid discharge flow-passage 153 is in a range of 90% to 95% of the flow rate of the liquid flowing in the first liquid supply flow-passage 152, and the flow rate of the liquid supplied from the aperture 154 to the substrate W is in a range of 5% to 10% of the flow rate of the liquid flowing in the first liquid supply flow-passage 152. A decrease in polishing performance due to dilution of the polishing liquid on the substrate W can be prevented by minimizing the flow rate of the liquid supplied through the aperture 154.

Figure 8:
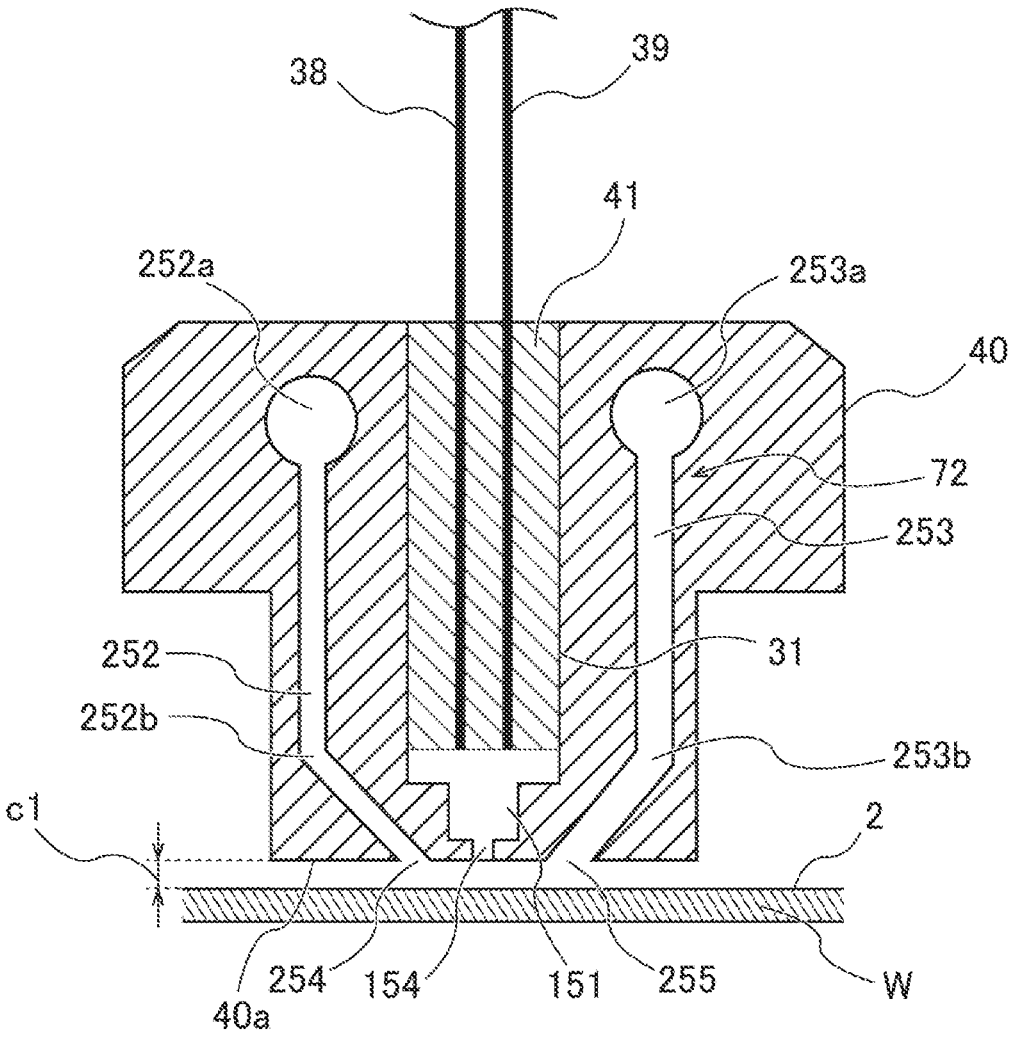
FIG. 8 is a cross-sectional view taken along line C-C of FIG. 6 schematically showing an embodiment of a second flow-passage system.
Figure 9:
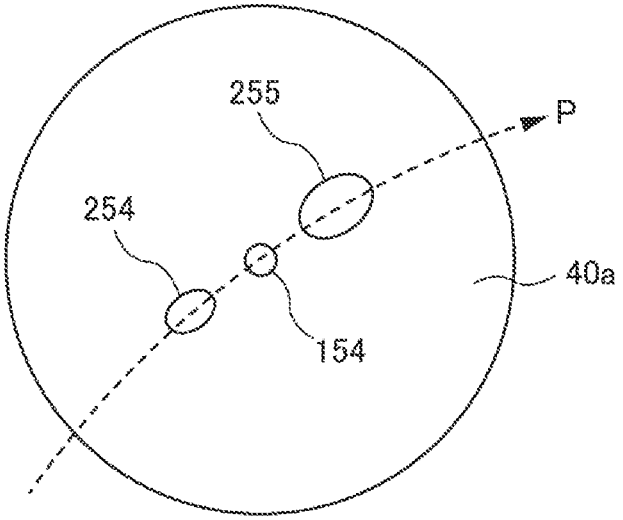
FIG. 9 is a diagram of the head nozzle according to the embodiment as viewed from below.

FIG. 8 is a cross-sectional view taken along line C-C of FIG. 6 schematically showing an embodiment of the second flow-passage system 72 of the head nozzle 40. FIG. 9 is a diagram of the head nozzle 40 according to the present embodiment as viewed from below. The second flow-passage system 72 of the head nozzle 40 has the second liquid supply flow-passage 252, the second liquid discharge flow-passage 253, the liquid outlet port 254, and the liquid suction port 255. The second liquid supply flow-passage 252 is coupled to the second liquid supply line 242 (see FIG. 1) at a third line connection 252*a*. The second liquid discharge flow-passage 253 is coupled to the second liquid discharge line 243 (see FIG. 1) at a fourth line connection 253*a*.

The liquid outlet port 254 communicates with a lower end of the second liquid supply flow-passage 252. The second liquid supply flow-passage 252 is bent at a bent portion 252*b*, and a lower portion of the second liquid supply flow-passage 252 is inclined toward the aperture 154 of the first flow-passage system 71. The liquid suction port 255 communicates with a lower end of the second liquid discharge flow-passage 253. The second liquid discharge flow-passage 253 is bent at a bent portion 253*b*, and a lower portion of the second liquid discharge flow-passage 253 is inclined toward the aperture 154 of the first flow-passage system 71. However, the second liquid supply flow-passage 252 and the second liquid discharge flow-passage 253 are not limited to the embodiment shown in FIG. 8. In one embodiment, the second liquid supply flow-passage 252 and the second liquid discharge flow-passage 253 do not have the bent portions 252*b* and 253*b*, and the entire second liquid supply flow-passage 252 and the entire second liquid discharge flow-passage 253 may be inclined toward the aperture 154 of the first flow-passage system 71.

As shown in FIG. 9, the liquid outlet port 254 and the liquid suction port 255 are located in the bottom surface 40*a* of the head nozzle 40, as well as the aperture 154. The liquid outlet port 254 and the liquid suction port 255 are located at both sides of the aperture 154, and the aperture 154 is located between the liquid outlet port 254 and the liquid suction port 255. More specifically, the liquid outlet port 254 and the liquid suction port 255 are arranged symmetrically with respect to the aperture 154. The liquid outlet port 254 is located upstream of the aperture 154 and the liquid suction port 255 in a rotating direction P of the substrate W.

Both the liquid outlet port 254 and the liquid suction port 255 are larger than the aperture 154. Further, the liquid suction port 255 is larger than the liquid outlet port 254. Specifically, an inner diameter of the lower end of the second liquid discharge flow-passage 253 is larger than an inner diameter of the lower end of the second liquid supply flow-passage 252. The liquid outlet port 254 can be close to the surface of the substrate W so as to face the surface of the substrate W in order to supply the liquid onto the surface of the substrate W. The liquid suction port 255 can be close to the surface of the substrate W so as to face the surface of the substrate W in order to suck the liquid on the surface of the substrate W. In one embodiment, a distance c1 from lower ends of the liquid outlet port 254 and the liquid suction port 255 to the surface of the substrate W, i.e., a distance from the bottom surface 40*a* of the head nozzle 40 to the polishing-target surface 2, is in a range of 0.5 mm to 1.0 mm.

When the second supply valve 244 (see FIG. 1) is opened, liquid flowing in the second liquid supply line 242 passes through the second liquid supply flow-passage 252 and is supplied from the liquid outlet port 254 onto the surface of the substrate W (polishing-target surface 2). When the second discharge valve 245 (see FIG. 1) is opened, the liquid on the surface (polishing-target surface 2) of the substrate W is sucked into the liquid suction port 255, flows through the second liquid discharge flow-passage 253 into the second liquid discharge line 243, and is discharged outside the second liquid discharge line 243 by the liquid pump 248. In one embodiment, the second supply valve 244 is configured such that flow rate of the liquid supplied from the liquid outlet port 254 to the substrate W is higher than flow rate of the liquid flowing through the aperture 154.

When the second supply valve 244 and the second discharge valve 245 are opened, the liquid is supplied onto the surface of the substrate W from the liquid outlet port 254, and flows through a gap between the aperture 154 and the substrate W along the rotating direction P of the substrate W to the liquid suction port 255. This liquid is mixed with the liquid flowing out from the aperture 154. Specifically, the flow of the liquid from the liquid outlet port 254 toward the liquid suction port 255 and the flow of the liquid that has passed through the aperture 154 merge, and the liquids that have formed these two flows are sucked into the liquid suction port 255.

In this way, the mixture of liquids flows along the rotating direction P of the substrate W and is sucked through the liquid suction port 255. The polishing liquid and the polishing debris existing between the aperture 154 and the substrate W are removed by this flow of the liquids. Since the optical path between the aperture 154 and the substrate W is filled with the transparent liquid during measuring of the film thickness, the film thickness of the substrate W can be measured with high accuracy. In particular, according to the present embodiment, since the flow of the liquid from the liquid outlet port 254 to the liquid suction port 255 is formed on the surface of the substrate W, the optical path between the aperture 154 and the substrate W can be filled with the transparent liquid even when a rotation speed of the substrate W is high.

The liquid supplied to the substrate W from the second liquid supply line 242 is, for example, pure water. The liquid may be a transparent liquid, and may be, for example, a KOH solution used as a polishing liquid. The second supply valve 244 and the second discharge valve 245 may be opened at all times during polishing of the substrate W regardless of the position of the film-thickness measuring head 31, or may be opened only when the film-thickness measuring head 31 is in the measuring position. During measuring of the film-thickness of the substrate W, the first supply valve 144 and the first discharge valve 145 of the first flow-passage system 71 and the second supply valve 244 and the second discharge valve 245 of the second flow-passage system 72 are open at the same time.

Figure 10:
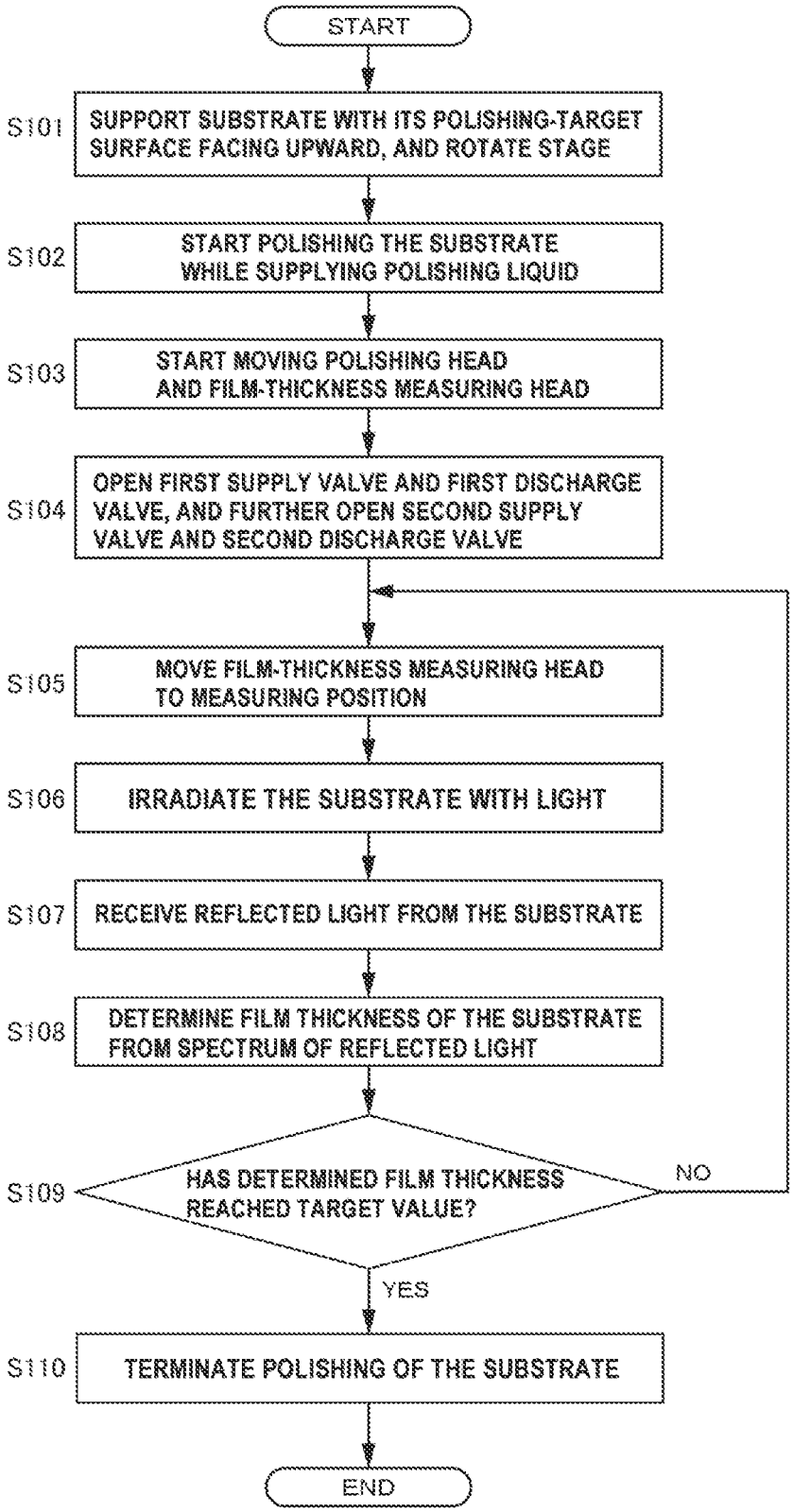
FIG. 10 is a flowchart illustrating an example of a process of measuring a film thickness of a substrate.

FIG. 10 is a flowchart illustrating an example of a process of measuring the film thickness of the substrate W.

In step S101, the stage 10 supports the substrate W with the polishing-target surface 2 of the substrate W facing upward, and the stage rotating mechanism rotates the stage 10.

In step S102, the polishing unit 20 starts polishing the substrate W while supplying the polishing liquid onto the substrate W from the polishing-liquid supply nozzles 28.

In step S103, the polishing-head moving mechanism 24 starts moving the polishing head 21, and the film-thickness measuring head moving mechanism 37 starts moving the film-thickness measuring head 31. The polishing head 21 and the film-thickness measuring head 31 move so as not to come into contact with each other.

In step S104, the first supply valve 144 and the first discharge valve 145 are opened, so that liquid is supplied to the fluid chamber 151 of the head nozzle 40 while the liquid is discharged from the fluid chamber 151. Further, the second supply valve 244 and the second discharge valve 245 are opened to start supplying the liquid from the head nozzle 40.

In step S105, the film-thickness measuring head 31 is moved to the measuring position, and the aperture 154, the liquid outlet port 254, and the liquid suction port 255 of the head nozzle 40 come close to the surface of the substrate W. The liquid flows out through the aperture 154 of the head nozzle 40 and the liquid is supplied from the liquid outlet port 254 to the substrate W, while the liquid on the substrate W is sucked through the liquid suction port 255. The flow of the liquid from the liquid outlet port 254 toward the liquid suction port 255 is formed on the surface of the substrate W. The aperture 154 faces this flow of the liquid, and the liquid flowing out from the aperture 154 merges with the flow of the liquid from the liquid outlet port 254 toward the liquid suction port 255.

In step S106, the light source 32 emits the light, which is transmitted from the film-thickness measuring head 31 to the surface of the substrate W through the fluid chamber 151 and the aperture 154.

In step S107, the film-thickness measuring head 31 receives the reflected light from the substrate W through the fluid chamber 151 and the aperture 154. Both the light from the film-thickness measuring head 31 and the reflected light from the substrate W travels through the liquid flowing in the fluid chamber 151, the liquid flowing in the aperture 154, and the liquid flowing from the liquid outlet port 254 to the liquid suction port 255, which ensure a good optical path.

In step S108, the spectrometer 33 measures the intensity of the reflected light from the substrate W at each of the wavelengths, and transmits the intensity measurement data of the reflected light to the spectrum analyzer 34. The spectrum analyzer 34 generates the spectrum of the reflected light from the intensity measurement data of the reflected light, and determines the film thickness of the substrate W.

In step S109, the operation controller 60 determines whether the determined film thickness of the substrate W has reached the target value. When the determined film thickness of the substrate W has reached the target value ("YES" in the step S109), the polishing unit 20 terminates polishing of the substrate W (step S110). When the determined film thickness of the substrate W has not reached the target value ("NO" in the step S109), the polishing unit 20 continues polishing the substrate W and repeats the steps S105 to S109.

Figure 11:
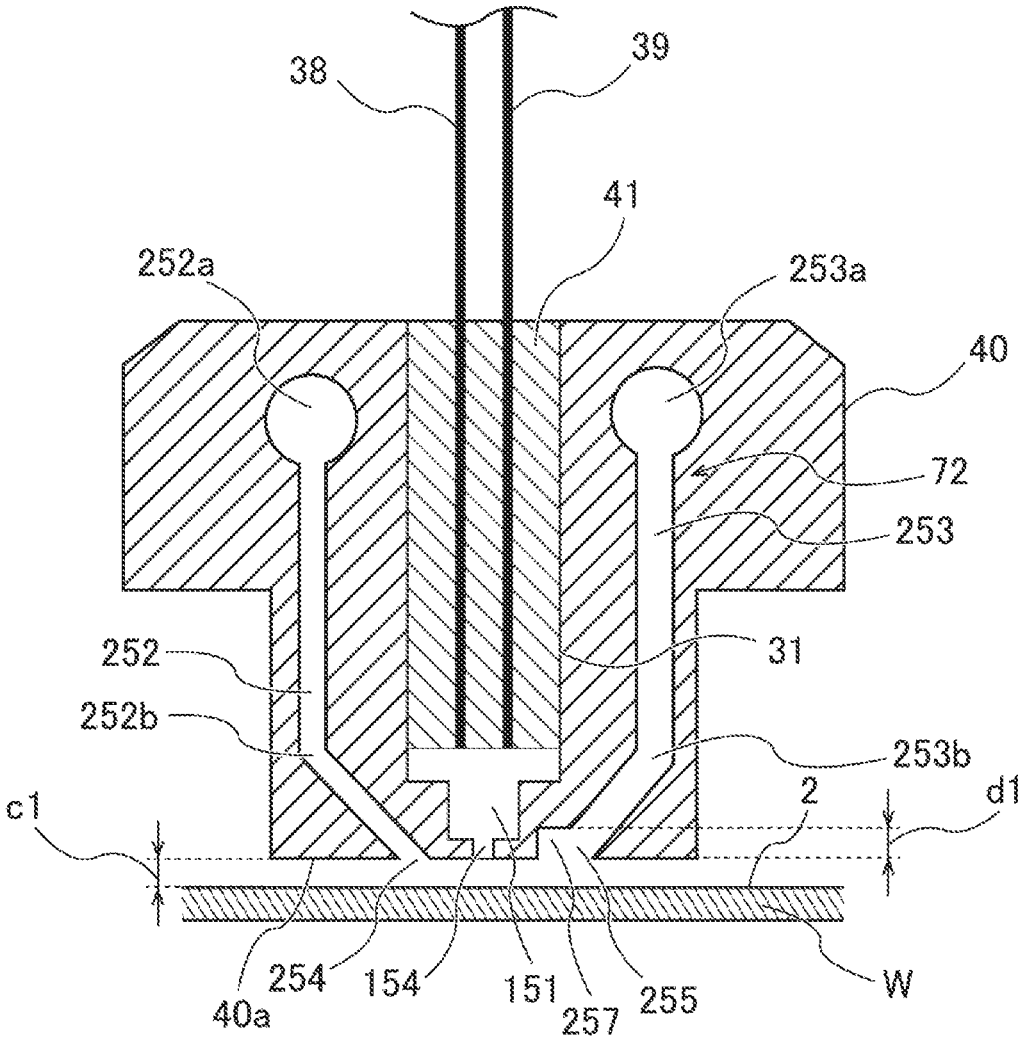
FIG. 11 is a cross-sectional view schematically showing another embodiment of the second flow-passage system of the head nozzle.
Figure 12:
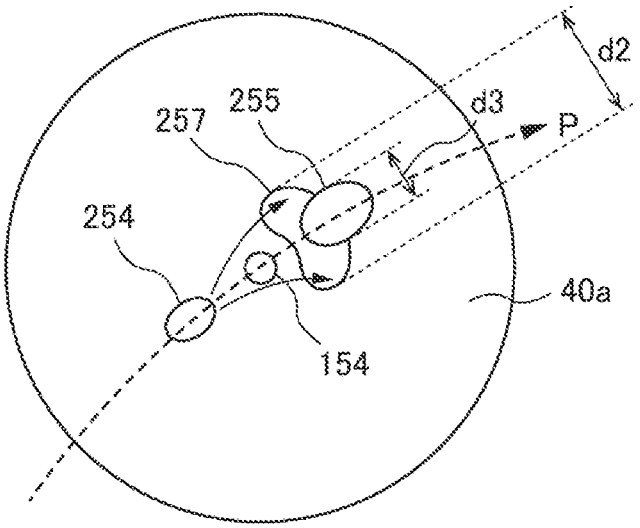
FIG. 12 is a diagram of the head nozzle according to the embodiment shown in FIG. 11 as viewed from below.

FIG. 11 is a cross-sectional view schematically showing another embodiment of the second flow-passage system 72 of the head nozzle 40. FIG. 12 is a diagram of the head nozzle 40 according to the embodiment shown in FIG. 11 as viewed from below. The second flow-passage system 72 shown in FIG. 11 further includes a liquid collecting groove 257. The liquid collecting groove 257 is located in the bottom surface 40*a* of the head nozzle 40. The liquid collecting groove 257 is a recess coupled to the liquid suction port 255, and the liquid collecting groove 257 communicates with the second liquid discharge flow-passage 253 via the liquid suction port 255. The liquid collecting groove 257 can be close to the surface of the substrate W so as to face the surface of the substrate W in order to collect and discharge the liquid on the surface of the substrate W. In one embodiment, a height d1 of the liquid collecting groove 257, i.e., a height from the bottom surface 40*a* of the head nozzle 40 to an upper end of the liquid collecting groove 257, is in a range of 0.3 mm to 5.0 min.

As shown in FIG. 12, the liquid collecting groove 257 is located upstream of the liquid suction port 255 and downstream of the aperture 154 in the rotating direction P of the substrate W. The liquid collecting groove 257 has a substantially elliptical shape when the head nozzle 40 is viewed from below. A width d2 of the liquid collecting groove 257 is larger than a width d3 of the liquid suction port 255. The width d2 of the liquid collecting groove 257 is a width in a direction substantially orthogonal to the rotating direction P of the substrate W, and the width d3 of the liquid suction port 255 is a width in a direction substantially orthogonal to the rotating direction P of the substrate W.

As shown by arrows in FIG. 12, the liquid that has been supplied from the liquid outlet port 254 onto the surface of the substrate W flows along the rotating direction P of the substrate W and spreads outward, and this liquid is then collected by the liquid collecting groove 257 and discharged through the second liquid discharge flow-passage 253. In this manner, the liquid collecting groove 257 can collect the liquids that have flowed out from the aperture 154 and the liquid outlet port 254 and can therefore prevent the decrease in the polishing performance due to dilution of the polishing liquid on the substrate W.

The liquid collecting groove 257 is not limited to the embodiment shown in FIG. 12. The liquid collecting groove 257 may have, for example, an elliptical shape or a substantially fan shape, as long as the width d2 of the liquid collecting groove 257 is larger than the width d3 of the liquid suction port 255.

Figure 13:
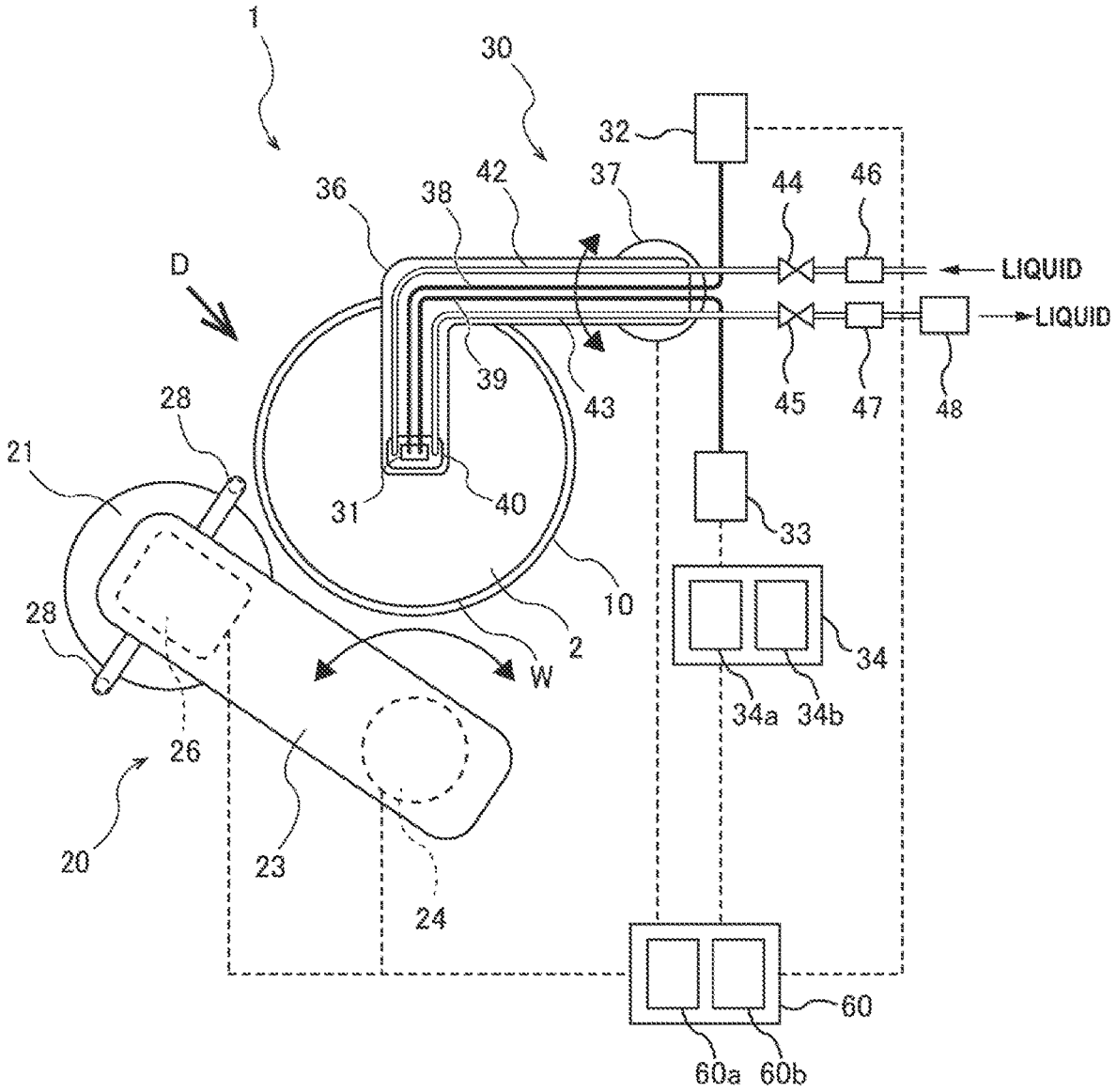
FIG. 13 is a plan view showing an embodiment of a substrate polishing apparatus.
Figure 14:
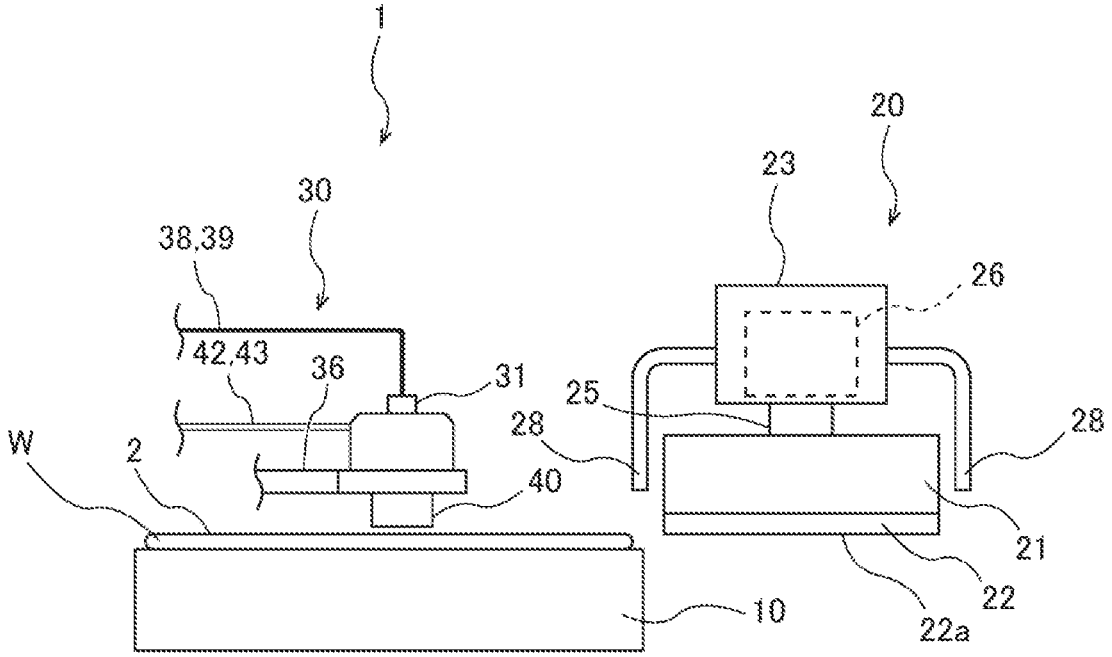
FIG. 14 is a side view of the substrate polishing apparatus shown in FIG. 13 as viewed in a direction of an arrow D.

FIG. 13 is a plan view showing an embodiment of a substrate polishing apparatus 1. FIG. 14 is a side view of the substrate polishing apparatus 1 shown in FIG. 13 as viewed in a direction of an arrow D. Configurations of this embodiment, which will not be particularly described, are the same as the above-described embodiments described with reference to FIGS. 1 and 2, and duplicated description will be omitted.

A head nozzle 40 of this embodiment is coupled to a liquid supply line 42 configured to supply liquid to the head nozzle 40 and a liquid discharge line 43 configured to discharge liquid from the head nozzle 40. The liquid supply line 42 is coupled to a liquid supply source (not shown). The liquid supplied to the head nozzle 40 is, for example, pure water. The liquid may be a transparent liquid, and may be, for example, a KOH solution used as a polishing liquid. A supply valve 44 and a flow meter 46 are attached to the liquid supply line 42. A discharge valve 45, a flow meter 47, and a liquid pump 48, such as an ejector, are attached to the liquid discharge line 43. The supply valve 44 and the discharge valve 45 may be manually operated. Alternatively, the supply valve 44 and the discharge valve 45 are coupled to the operation controller 60, and operations of the supply valve 44 and the discharge valve 45 may be controlled by the operation controller 60. The head nozzle 40 will be described in detail later.

Figure 15:
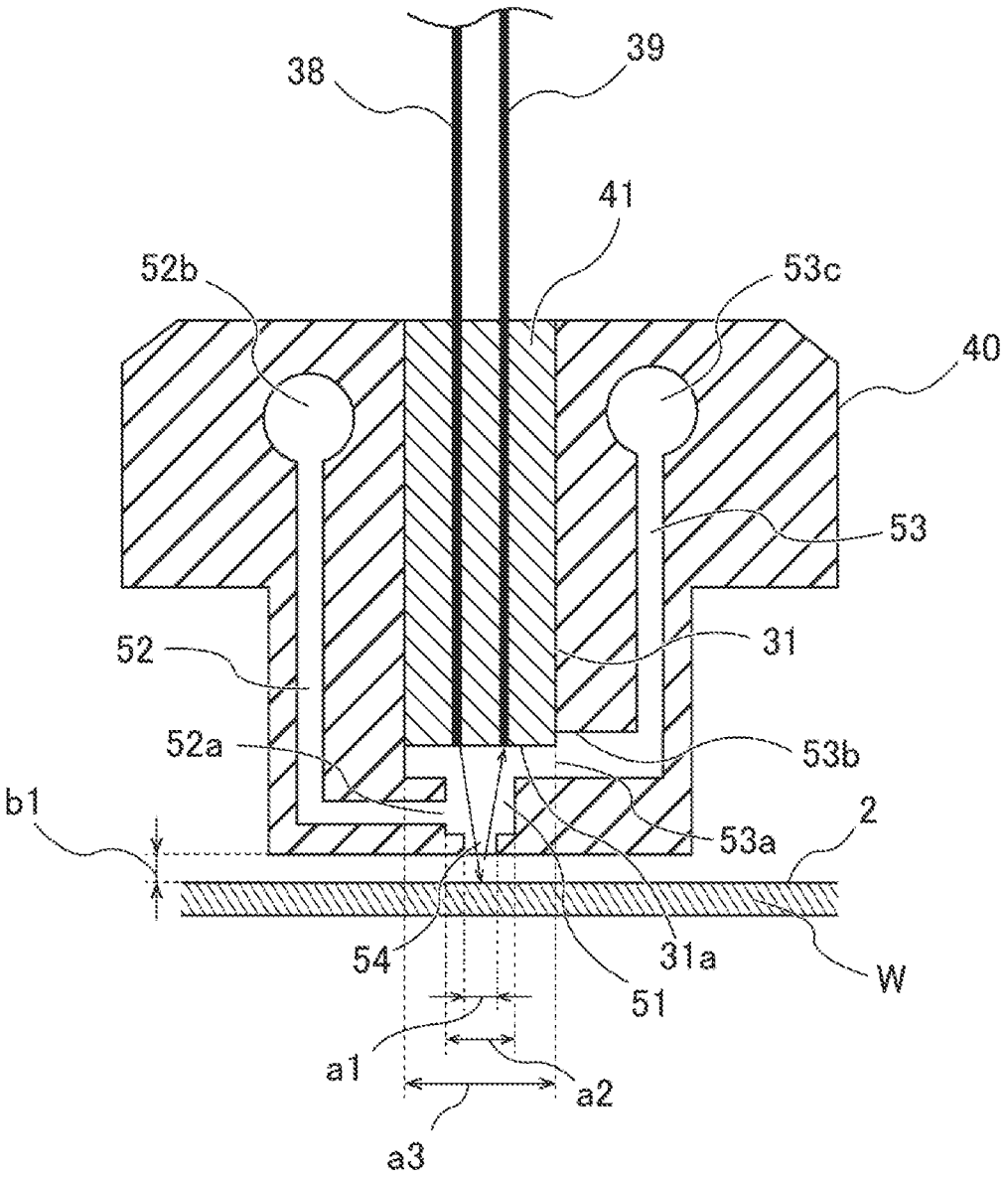
FIG. 15 is a cross-sectional view schematically showing another embodiment of the head nozzle.

Next, details of the head nozzle 40 of the present embodiment will be described. FIG. 15 is a cross-sectional view schematically showing an embodiment of the head nozzle 40. A film-thickness measuring head 31 has distal ends of a light-emitting optical fiber cable 38 and a light-receiving optical fiber cable 39, and a fiber holder 41 holding these distal ends. The head nozzle 40 has a shape that covers the end portion of the film-thickness measuring head 31. The head nozzle 40 has a fluid chamber 51, a liquid supply flow-passage 52, a liquid discharge flow-passage 53, and an aperture 54. The fluid chamber 51 is provided on an optical path of light emitted from the film-thickness measuring head 31 to the surface of the substrate W and reflected light from the substrate W to be received by the film-thickness measuring head 31. A lower end 31*a* of the film-thickness measuring head 31 faces the fluid chamber 51.

The liquid supply flow-passage 52 and the liquid discharge flow-passage 53 are coupled to the fluid chamber 51. The liquid supply flow-passage 52 is coupled to the liquid supply line 42 (see FIG. 13) at a first line connection 52*b*. The liquid discharge flow-passage 53 is coupled to the liquid discharge line 43 (see FIG. 13) at a second line connection 53*c*. A first connection 52*a* between the liquid supply flow-passage 52 and the fluid chamber 51 is located lower than a second connection 53*a* between the liquid discharge flow-passage 53 and the fluid chamber 51. More specifically, the first connection 52*a* between the liquid supply flow-passage 52 and the fluid chamber 51 is located at a lower portion of the fluid chamber 51, and the second connection 53*a* between the liquid discharge flow-passage 53 and the fluid chamber 51 is located at an upper portion of the fluid chamber 51.

Since the first connection 52*a* between the liquid supply flow-passage 52 and the fluid chamber 51 is located at the lower portion of the fluid chamber 51, liquid flows into the fluid chamber 51 from the first connection 52*a* at a position lower than a liquid level of liquid already existing in the fluid chamber 51. As a result, a collision between the liquid flowing into the fluid chamber 51 through the first connection 52*a* and the liquid already existing in the fluid chamber 51 is alleviated, and generation of bubbles due to the collision between the liquids can be reduced. In addition, since the second connection 53*a* between the liquid discharge flow-passage 53 and the fluid chamber 51 is located at the upper portion of the fluid chamber 51, air bubbles generated in the fluid chamber 51 can be discharged quickly through the liquid discharge flow-passage 53.

The aperture 54 is provided on the optical path of the light emitted from the film-thickness measuring head 31 to the surface of the substrate W and the reflected light from the substrate W to be received by the film-thickness measuring head 31. The aperture 54 communicates with the lower end of the fluid chamber 51, and a width a1 of the aperture 54 is smaller than a width a2 of the fluid chamber 51. As a result, the bubbles generated in the fluid chamber 51 are dispersed to the upper portion of the fluid chamber 51 without staying in the aperture 54. In one embodiment, the width a1 of the aperture 54 is in a range of 1.0 mm to 2.0 mm. This is to minimize flow rate of liquid flowing out from the fluid chamber 51 through the aperture 54 to prevent dilution of the polishing liquid on the substrate W, and to ensure a passage for the light emitted from the film-thickness measuring head 31 and the reflected light from the substrate W. The aperture 54 can be close to the surface of the substrate W so as to face the surface of the substrate W in order to measure the film thickness of the substrate W. In one embodiment, a distance b1 from a lower end of the aperture 54 to the surface of the substrate W, i.e., a distance b1 from a lower end of the aperture 54 to the polishing-target surface 2, is in a range of 0.5 mm to 1.0 mm. This is also to minimize the flow rate of the liquid flowing out from the fluid chamber 51 through the aperture 54 to prevent dilution of the polishing liquid on the substrate W.

The light-emitting optical fiber cable 38 and the light-receiving optical fiber cable 39 may be a bundle type in which a plurality of light-receiving optical fiber cables 39 are arranged and bundled on outside of a plurality of light-emitting optical fiber cables 38. Alternatively, the light-emitting optical fiber cable 38 and the light-receiving optical fiber cable 39 may not be bundled.

The width a2 of a portion of the fluid chamber 51 at a position of the first connection 52*a* between the liquid supply flow-passage 52 and the fluid chamber 51 is smaller than a width a3 of a portion of the fluid chamber 51 facing the lower end 31*a* of the film-thickness measuring head 31. As a result, the bubbles generated in the fluid chamber 51 are dispersed outside the optical path without staying on the optical path during measuring of the film thickness. The second connection 53*a* is located at the lower end 31*a* of the film-thickness measuring head 31. More specifically, an upper surface 53*b* of the liquid discharge flow-passage 53 extending from the second connection 53*a* is located higher than the lower end 31*a* of the film-thickness measuring head 31. With such an arrangement, the bubbles can be discharged quickly through the liquid discharge flow-passage 53 without staying in the fluid chamber 51.

When the supply valve 44 (see FIG. 13) is opened, liquid flowing in the liquid supply line 42 is supplied into the fluid chamber 51 through the liquid supply flow-passage 52. The liquid that has been supplied to the fluid chamber 51 is supplied onto the polishing-target surface 2 of the substrate W through the aperture 54. When the discharge valve 45 (see FIG. 13) is opened, the liquid in the fluid chamber 51 flows through the liquid discharge flow-passage 53 into the liquid discharge line 43, and is discharged outside the liquid discharge line 43 by the liquid pump 48 (see FIG. 13). The supply valve 44 and the discharge valve 45 are configured such that flow rate of the liquid flowing in the liquid supply flow-passage 52 is higher than flow rate of the liquid flowing in the liquid discharge flow-passage 53. The liquid supplied from the liquid supply line 43 is, for example, pure water. The liquid may be a transparent quid, and may be, for example, a KOH solution used as a polishing liquid. When the supply valve 44 and the discharge valve 45 are opened, the fluid chamber 51 is filled with the liquid, and the liquid is supplied to the substrate W to remove foreign matter, such as the polishing liquid, on the substrate W. Since the optical path is filled with the transparent liquid during measuring of the film thickness, the film thickness of the substrate W being polished can be measured with high accuracy. The supply valve 44 and the discharge valve 45 may be opened at all times during polishing of the substrate W regardless of the position of the film-thickness measuring head 31, or may be opened only when the film-thickness measuring head 31 is in the measuring position.

In one embodiment, the flow rate of the liquid flowing in the liquid discharge flow-passage 53 is in a range of 90% to 95% of the flow rate of the liquid flowing in the liquid supply flow-passage 52, and the flow rate of the liquid supplied from the aperture 54 to the substrate W is in a range of 5% to 10% of the flow rate of the liquid flowing in the liquid supply flow-passage 52. A decrease in polishing performance due to dilution of the polishing liquid on the substrate W can be prevented by minimizing the flow rate of the liquid supplied through the aperture 54.

Figure 16:
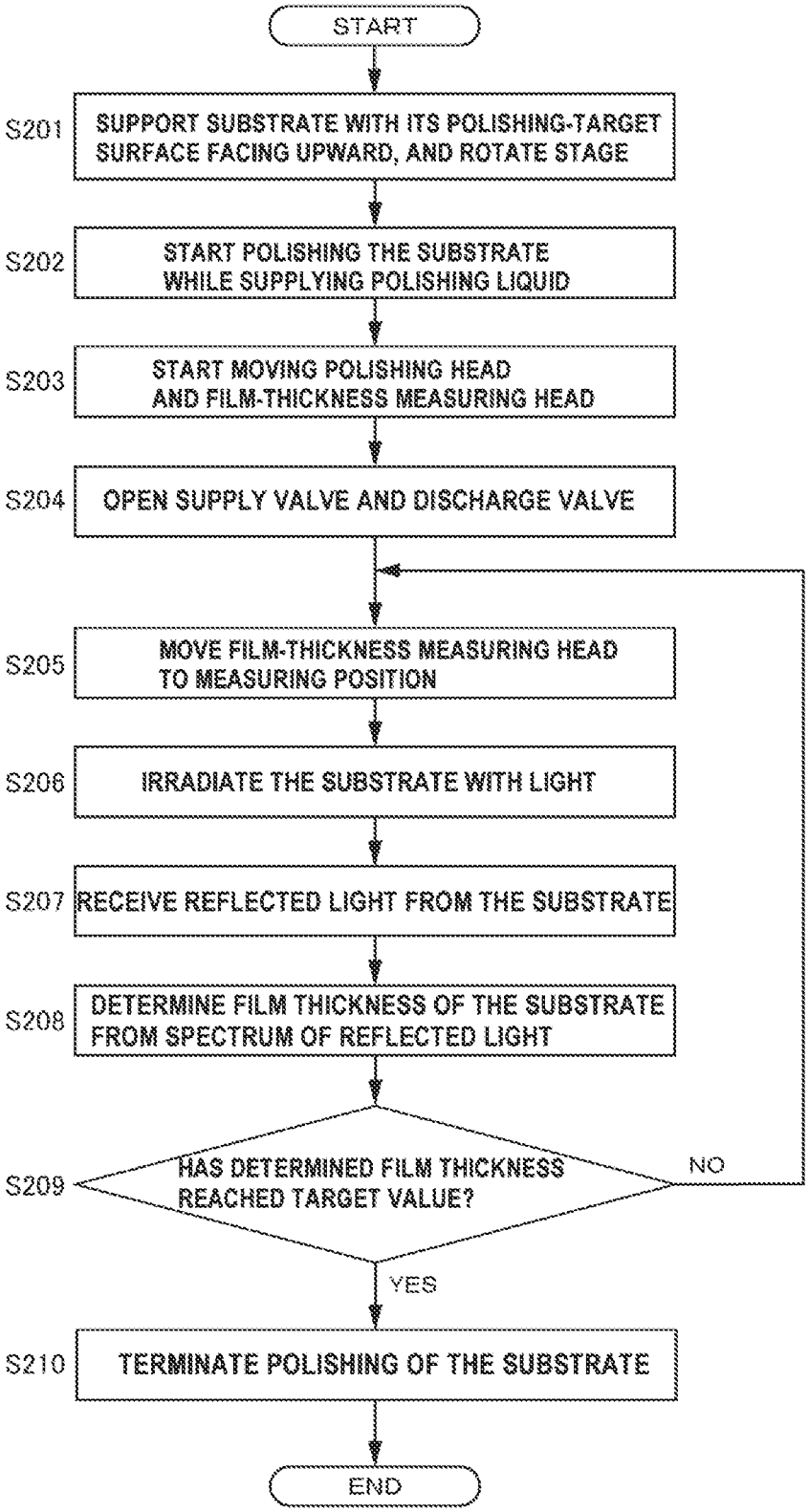
FIG. 16 is a flowchart illustrating an example of a process of measuring the film thickness of the substrate.

FIG. 16 is a flowchart illustrating an example of a process of measuring the film thickness of the substrate W.

In step S201, the stage 10 supports the substrate W with the polishing-target surface 2 of the substrate W facing upward, and the stage rotating mechanism rotates the stage 10.

In step S202, the polishing unit 20 starts polishing the substrate W While supplying the polishing liquid onto the substrate W from the polishing-liquid supply nozzles 28.

In step S203, the polishing-head moving mechanism 24 starts moving the polishing head 21, and the film-thickness measuring head moving mechanism 37 starts moving the film-thickness measuring head 31. The polishing head 21 and the film-thickness measuring head 31 move so as not to come into contact with each other.

In step S204, the supply valve 44 and the discharge valve 45 are opened, so that liquid is supplied to the fluid chamber 51 of the head nozzle 40 while the liquid is discharged from the fluid chamber 51.

In step S205, the film-thickness measuring head 31 is moved to the measuring position, the aperture 54 of the head nozzle 40 comes close to the surface of the substrate W, and the liquid is supplied from the head nozzle 40 to the substrate W.

In step S206, the light source 32 emits the light, which is transmitted from the film-thickness measuring head 31 to the surface of the substrate W through the fluid chamber 51 and the aperture 54.

In step S207, the film-thickness measuring head 31 receives the reflected light from the substrate W through the fluid chamber 51 and the aperture 54.

In step S208, the spectrometer 33 measures the intensity of the reflected light from the substrate W at each of the wavelengths, and transmits the intensity measurement data of the reflected light to the spectrum analyzer 34. The spectrum analyzer 34 generates the spectrum of the reflected light from the intensity measurement data of the reflected light, and determines the film thickness of the substrate W.

In step S209, the operation controller 60 determines whether the determined film thickness of the substrate W has reached the target value. When the determined film thickness of the substrate W has reached the target value ("YES" in the step S209), the polishing unit 20 terminates polishing of the substrate W (step S210). When the determined film thickness of the substrate W has not reached the target value ("NO" in the step S209), the polishing unit 20 continues polishing the substrate W and repeats the steps S205 to S209.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A substrate polishing apparatus comprising:

a stage configured to support a substrate and rotate the substrate with a surface of the substrate facing upward;

a polishing head configured to hold a polishing pad having a polishing surface for polishing the substrate supported by the stage;

a polishing-liquid supply nozzle configured to supply a polishing liquid onto the surface of the substrate;

a film-thickness measuring head configured to irradiate a measurement area on the surface of the substrate on the stage with light and receive reflected light from the measurement area;

a spectrum analyzer configured to generate a spectrum of the reflected light and determine a film thickness of the substrate from the spectrum; and a head nozzle to which the film-thickness measuring head is attached, wherein the head nozzle includes a first flow-passage system and a second flow-passage system each configured to form a flow of liquid across an optical path of the light and the reflected light, the first flow-passage system has an aperture located on the optical path, the second flow-passage system has a liquid outlet port and a liquid suction port located at both sides of the aperture.

2. The substrate polishing apparatus according to claim 1, wherein the liquid outlet port and the liquid suction port are arranged symmetrically with respect to the aperture.

3. The substrate polishing apparatus according to claim 1, wherein the aperture, the liquid outlet port, and the liquid suction port are located in a bottom surface of the head nozzle.

4. The substrate polishing apparatus according to claim 1, wherein the liquid outlet port is located upstream of the aperture and the liquid suction port in a rotating direction of the substrate.

5. The substrate polishing apparatus according to claim 1, wherein the first flow-passage system includes:

a fluid chamber provided on the optical path;

a first liquid supply flow-passage configured to supply liquid to the fluid chamber;

a first liquid discharge flow-passage configured to discharge liquid from the fluid chamber; and the aperture which communicates with a lower end of the fluid chamber and can be close to the surface of the substrate, and wherein the second flow-passage system includes:

a second liquid supply flow-passage configured to supply liquid onto the surface of the substrate;

a second liquid discharge flow-passage configured to discharge liquid on the surface of the substrate;

the liquid outlet port which communicates with the second liquid supply flow-passage and can be close to the surface of the substrate; and the liquid suction port which communicates with the second liquid discharge flow-passage and can be close to the surface of the substrate.

6. The substrate polishing apparatus according to claim 1, wherein both the liquid outlet port and the liquid suction port are larger than the aperture.

7. The substrate polishing apparatus according to claim 1, wherein the liquid suction port is larger than the liquid outlet port.

8. The substrate polishing apparatus according to claim 1, wherein the second flow-passage system further includes a liquid collecting groove which is coupled to the liquid suction port and can be close to the surface of the substrate, the liquid collecting groove is located upstream of the liquid suction port in a rotating direction of the substrate, and a width of the liquid collecting groove is larger than a width of the liquid suction port.

9. A substrate polishing apparatus comprising:

a stage configured to support a substrate with a surface of the substrate facing upward;

a polishing head configured to hold a polishing pad having a polishing surface for polishing the substrate supported by the stage;

a polishing-liquid supply nozzle configured to supply a polishing liquid on a surface of the substrate;

a film-thickness measuring head configured to irradiate a measurement area on the surface of the substrate on the stage with light and receive reflected light from the measurement area;

a spectrum analyzer configured to generate a spectrum of the reflected light and determine a film thickness of the substrate from the spectrum; and a head nozzle to which the film-thickness measuring head is attached, the head nozzle including:

a first flow-passage system and a second flow-passage system each configured to form a flow of liquid across an optical path of the light and the reflected light, the first flow-passage system has an aperture located on the optical path and can be close to the surface of the substrate, the second flow-passage system has a liquid outlet port and a liquid suction port located at both sides of the aperture, wherein the first flow passage system includes:

a fluid chamber provided on the optical path of the light and the reflected light;

a liquid supply flow-passage configured to supply liquid to the fluid chamber;

a liquid discharge flow-passage configured to discharge liquid from the fluid chamber;

wherein a first connection between the liquid supply flow-passage and the fluid chamber is located at a lower portion of the fluid chamber, a second connection between the liquid discharge flow-passage and the fluid chamber is located at an upper portion of the fluid chamber, and the aperture communicates with a lower end of the fluid chamber and a width of the aperture is smaller than a width of the fluid chamber.

10. The substrate polishing apparatus according to claim 9, wherein the second connection is located at a lower end of the film-thickness measuring head.

11. The substrate polishing apparatus according to claim 10, wherein an upper surface of the liquid discharge flow-passage extending from the second connection is located higher than the lower end of the film-thickness measuring head.

12. The substrate polishing apparatus according to claim 9, wherein the width of the aperture is in a range of 1.0 mm to 2.0 mm.

13. The substrate polishing apparatus according to claim 9, further comprising:

a supply valve coupled to the liquid supply flow-passage; and a discharge valve coupled to the liquid discharge flow-passage, wherein the supply valve and the discharge valve are configured such that flow rate of liquid flowing in the liquid supply flow-passage is higher than flow rate of liquid flowing in the liquid discharge flow-passage.

14. The substrate polishing apparatus according to claim 9, further comprising:

a polishing-head moving mechanism configured to move the polishing head between a polishing position and a non-polishing position;

a film-thickness measuring head moving mechanism configured to move the film-thickness measuring head between a measuring position and a non-measuring position; and an operation controller coupled to the polishing-head moving mechanism and the film-thickness measuring head moving mechanism, wherein the operation controller is configured to control the polishing-head moving mechanism and the film-thickness measuring head moving mechanism such that the polishing head and the film-thickness measuring head do not come into contact with each other.

* * * * *